US009677335B2

(12) United States Patent
Lenz, Jr. et al.

(10) Patent No.: US 9,677,335 B2
(45) Date of Patent: Jun. 13, 2017

(54) FIREFIGHTING OR RESCUE APPARATUS INCLUDING LADDER WITH STATUS INDICATORS

(71) Applicant: HME, Incorporated, Wyoming, MI (US)

(72) Inventors: Kenneth C. Lenz, Jr., Hudsonville, MI (US); Richard R. Lagerquist, Plainwell, MI (US)

(73) Assignee: HME, INCORPORATED, Wyoming, MI (US)

( * ) Notice: Subject to any disclaimer, the term of this patent is extended or adjusted under 35 U.S.C. 154(b) by 124 days.

(21) Appl. No.: 14/669,901

(22) Filed: Mar. 26, 2015

(65) Prior Publication Data

US 2015/0273255 A1 Oct. 1, 2015

Related U.S. Application Data

(60) Provisional application No. 61/973,506, filed on Apr. 1, 2014.

(51) Int. Cl.
*E06C 5/34* (2006.01)
*E06C 5/04* (2006.01)
(Continued)

(52) U.S. Cl.
CPC ..... *E06C 5/04* (2013.01); *E06C 5/34* (2013.01); *E06C 5/36* (2013.01); *A62C 27/00* (2013.01)

(58) Field of Classification Search
CPC ..... G09G 3/00; A62C 27/00; A62C 31/24; E06C 5/32; E06C 5/34; E06C 5/36; E06C 5/44; E06C 7/00
See application file for complete search history.

(56) References Cited

U.S. PATENT DOCUMENTS 3,842,935 A * 10/1974 Frank ..... E04D 13/035 182/81
3,965,464 A * 6/1976 Kozai ..... E06C 7/003 182/18

(Continued)

FOREIGN PATENT DOCUMENTS

| | | |
|---|---|---|
| CA | 1215793 | 12/1986 |
| EP | 2199530 | * 6/2010 |
| EP | 2199530 | 4/2011 |

OTHER PUBLICATIONS

2012 Rosenbauer Lighted Aerial Ladder, downloaded from http://legeros.com/ralwake/photos/weblog/pivot/entry.php?id=5033.

*Primary Examiner* — Daniel Cahn
(74) *Attorney, Agent, or Firm* — Warner Norcross and Judd, LLP

(57) ABSTRACT

A firefighting or rescue apparatus includes an aerial ladder and at least one of a rung alignment status indicator and a load status indicator. The rung alignment status indicator can include a lighting strip having multiple lighting elements on the ladder that are selectively illuminated depending on whether first rungs of one section of the ladder and second rungs of another section of the ladder are aligned or misaligned. The load status indicator can include a lighting strip including multiple lighting elements on the ladder and/or at a control console that are selectively illuminated depending on whether the ladder is overloaded beyond an aerial ladder capacity rating or other value. A user on the aerial ladder and/or at a control console can view the indicators to evaluate rung alignment and load status.

11 Claims, 21 Drawing Sheets

(51) Int. Cl.
*E06C 5/36* (2006.01)
*A62C 27/00* (2006.01)

(56) References Cited

U.S. PATENT DOCUMENTS 3,966,017 A * 6/1976 Maeda ..... E06C 5/04 182/18
3,978,944 A * 9/1976 Hickman ..... E06C 1/22 182/162
3,980,157 A * 9/1976 Wrigley ..... B63B 27/14 16/357
4,298,093 A * 11/1981 Wing ..... E04G 1/34 182/153
4,366,591 A * 1/1983 Zimmerman ..... B63B 27/14 14/71.3
4,905,793 A * 3/1990 Paulson ..... E06C 7/10 182/215
5,513,866 A * 5/1996 Sisson ..... B60R 3/02 105/449
5,762,163 A * 6/1998 Kain ..... E06C 1/393 182/161
7,389,854 B1 * 6/2008 Johnson ..... B60R 9/00 182/127
7,614,393 B1 * 11/2009 Lu ..... F42B 6/006 124/3
7,984,557 B1 * 7/2011 Carl ..... B66C 13/46 33/263
8,074,767 B1 * 12/2011 Denison ..... B66F 11/046 182/194
8,413,764 B1 * 4/2013 Cohen ..... E06C 7/18 182/62.5
9,447,639 B2 * 9/2016 Cohen ..... E06C 7/18
2003/0158635 A1 * 8/2003 Pillar ..... A62C 27/00 701/1
2003/0158638 A1 * 8/2003 Yakes ..... A62C 27/00 701/22
2003/0158640 A1 * 8/2003 Pillar ..... A62C 27/00 701/29.4
2003/0163228 A1 * 8/2003 Pillar ..... A62C 27/00 701/1
2003/0163229 A1 * 8/2003 Pillar ..... A62C 27/00 701/1
2003/0163230 A1 * 8/2003 Pillar ..... A62C 27/00 701/1
2003/0171854 A1 * 9/2003 Pillar ..... A62C 27/00 701/1
2004/0024502 A1 * 2/2004 Squires ..... A62C 27/00 701/29.3
2004/0039510 A1 * 2/2004 Archer ..... A62C 27/00 701/48
2004/0069865 A1 * 4/2004 Rowe ..... A62C 27/00 239/146
2004/0199302 A1 * 10/2004 Pillar ..... A62C 27/00 701/1
2005/0113988 A1 * 5/2005 Nasr ..... A62C 27/00 701/22
2005/0114007 A1 * 5/2005 Pillar ..... A62C 27/00 701/82
2005/0209747 A1 * 9/2005 Yakes ..... B60K 6/46 701/22
2006/0070804 A1 * 4/2006 Lapke ..... B60R 3/02 182/127
2006/0076189 A1 * 4/2006 Ziaylek ..... E06C 5/04 182/127
2006/0169536 A1 * 8/2006 Davis ..... E06C 5/04 182/127
2008/0019815 A1 * 1/2008 Harris ..... B66C 23/80 414/563
2008/0215700 A1 * 9/2008 Pillar ..... A62C 27/00 709/212
2013/0193666 A1 * 8/2013 Kibler ..... E06C 5/06 280/163
2014/0041964 A1 * 2/2014 Bedyk ..... E06C 5/04 182/106
2014/0334169 A1 * 11/2014 Ewert ..... A62C 27/00 362/485
2015/0136523 A1 * 5/2015 Madera ..... E06C 5/04 182/113
2015/0203078 A1 * 7/2015 Kraemer ..... B60S 9/10 254/423
2015/0273255 A1 * 10/2015 Lenz, Jr. ..... E06C 5/04 280/4
2015/0330146 A1 * 11/2015 Kraemer ..... B66C 23/78 701/34.4
2015/0376945 A1 * 12/2015 Karremann ..... E06C 5/32 701/49
2016/0166862 A1 * 6/2016 Qui ..... A62C 3/025 169/24
2016/0176692 A1 * 6/2016 Sawodny ..... B66F 17/006 701/50
2016/0228733 A1 * 8/2016 Ceresani ..... A62C 33/04

* cited by examiner

FIREFIGHTING OR RESCUE APPARATUS INCLUDING LADDER WITH STATUS INDICATORS

BACKGROUND OF THE INVENTION

The present invention relates to a firefighting apparatus, such as a fire truck, a trailer or other vehicles, and more particularly to a firefighting apparatus with an aerial ladder and at least one of a rung alignment status indicator and a load status indicator.

There are a variety of fire trucks and rescue vehicles that include aerial ladders to assist in the fighting of fires. These aerial ladders usually are mounted on a frame or chassis of a fire truck. The ladder can be raised from a generally horizontal position to an angled position so that the ladder extends updwardly from the frame. The ladder can be extended and retracted to achieve varying heights for rescue operations and/or for the application of firefighting fluids.

Generally, aerial ladder trucks are used to fight fires from elevated positions or to rescue victims trapped in burning buildings. Many times, an aerial ladder truck is dispatched to an emergency location such as the location of a traffic accident, a boating accident, a plane accident, a man-made or natural disaster and/or a terrorist attack, where the aerial ladder is to be used to rescue one or more individuals, or to provide elevated application of firefighting fluids.

Use of the aerial ladder can ladder be complex and dangerous in many ways. For example, where sections of an aerial ladder are partially extended, the rungs of one ladder section can be misaligned with the rungs of another ladder section. In turn, a user of the ladder will have a decreased foot hold on the outermost section's rungs. In some cases, the user may not even be able to attain a foothold on a rung, in which case the user can lose their footing and possibly fall. Some manufacturers have attempted to address this by placing sensors on the ladder rungs. The sensors can send signals to a control box of the aerial ladder. The control box can light a small bulb on the control box when the sensors sense the rungs are misaligned. In such a case, a user standing immediately adjacent the control box, operating the aerial ladder, becomes aware of the misalignment and unsafe condition. Another user on or entering the aerial ladder, however, usually is completely unaware of the rung misalignment and the lit bulb because they are out of view of the same. In this case, the user entering the aerial ladder might not use extra care or refrain from entering the ladder, which could result in injury if the user cannot attain a safe footing on the misaligned ladder rungs.

As another example of the danger in operating aerial ladders, in some cases, the load on the ladder sections is significant (due to the weight of users and/or equipment high up the ladder). This can create a moment sufficient to overturn the fire truck. Some manufacturers have attempted to address this by placing load sensors on the aerial ladder to identify unsafe loading. The sensors can send signals to a control box of the aerial ladder. The control box can light a small bulb on the control box when the sensors sense an unsafe loading condition. In such a case, a user standing immediately adjacent the control box, operating the aerial ladder, becomes aware of the unsafe loading condition. Another user on or entering the aerial ladder, however, usually is completely unaware of the loading condition and the lit bulb because they are out of view of the same. In this case, the user on the aerial ladder might continue up the ladder to make the loading conditions even more unsafe. Further, when an emergency location is noisy, the user adjacent the control box may not be able to warn the user on the ladder of the unsafe condition. This can lead to toppling of the fire truck in some extreme load situations.

Thus, while aerial ladder trucks are currently available and helpful in a variety of situations, there remains room for improvement in their function, safe operation and safe utilization.

SUMMARY OF THE INVENTION

A firefighting or rescue apparatus is provided including an aerial ladder and at least one of a rung alignment status indicator and a load status indicator. The rung alignment status indicator and load status indicator can be in the form of multiple lighting elements aligned along the aerial ladder, and optionally extending the length of one or more ladder sections of the aerial ladder. The lighting elements are visible to a user located on or adjacent the ladder to provide improved cognizance of the status of the aerial ladder, particularly in relation to rung alignment and/or overloading of the ladder.

In one embodiment, the rung alignment status indicator can include a lighting strip having multiple lighting elements on the ladder that are selectively illuminated depending on whether first rungs of one section of the ladder and second rungs of another section of the ladder are aligned or misaligned. A user on the aerial ladder can view the rung alignment status indicator and discern whether the ladder has appropriate rung alignment so the user can attain a safe foothold when climbing it.

In another embodiment, the load status indicator can include a lighting strip including multiple lighting elements on the ladder that are selectively illuminated depending on whether the ladder is overloaded beyond an aerial ladder capacity rating. A user on the aerial ladder can view the load status indicator to discern whether the ladder is improperly overloaded to a point where the apparatus might tip and/or overturn.

In still another embodiment, the apparatus can include a control console mounted adjacent the aerial ladder and configured to control movement of the aerial ladder. The control console can include a first console light adapted to selectively illuminate when the rungs of different ladder sections are aligned or misaligned. An operator standing adjacent the control tower can readily see the first console light, and can attain an understanding of rung alignment from the same. In addition, the operator standing adjacent the control console can directly view the rung alignment status indicator, and in particular, the multiple lighting elements on the ladder that are selectively illuminated depending on rung alignment or misalignment. In this manner, different lights, that is, the first console light and the lighting elements on the ladder can indicate the status of rung alignment of the ladder.

In yet another embodiment, the control console can include a second console light adapted to selectively illuminate when the loading of the ladder exceeds a preselected loading capacity, optionally by a certain percentage. An operator standing adjacent the control tower can readily see the second console light, and can attain an understanding of whether the ladder is at or approaching a load capacity that could render the apparatus unstable, or worse, tip or overturn the apparatus. In addition, the operator standing adjacent the control console can directly view the load status indicator, and in particular, the multiple lighting elements on the ladder that are selectively illuminated depending the loading of the aerial ladder. In this manner, different lights, that is, the second console light and the lighting elements on the ladder can indicate the status of loading on the ladder. Optionally, the second console light can include multiple lighting elements. These elements can be indicative of safe, cautionary and unsafe loading on the aerial ladder. The lights can be selectively illuminated based on actual loading of the ladder in relation to a predetermined load capacity rating.

In even another embodiment, the apparatus can include an audible alarm mounted to or near the control console, or some other part of the apparatus. The audible alarm can be in communication with the load status indicator and/or the control console, and can sound when a when a load capacity is exceeded by a certain amount, optionally by 0% to 25%, and further optionally by 1% to 10%. Further optionally, the audible alarm can be in the form of a horn, and can sound when the load on the ladder approaches or is near the ladder load capacity.

In a further embodiment, the multiple lighting elements can be in the form of LEDs mounted to an elongated strip of material. The elongated strip can be mounted to one or both opposing side rails associated with the aerial ladder. In some cases, the lighting elements or LEDs can be of multiple colors, where a first color indicates a first condition, such as misalignment of the rungs, and a second color indicates a second condition, such as alignment of the rungs.

The current embodiments provide a simple and effective construction that can facilitate enhanced safety when operating and utilizing an aerial ladder on a firefighting or rescue apparatus. Where the aerial ladder includes rung alignment status indicators, a user on the ladder, a user entering the ladder, and a user off the ladder all can perceive whether the ladder rungs are properly aligned, and thus whether the ladder is safe. In turn, one or more users can take action or use extra caution on the rungs. Where the aerial ladder includes a loading status indicator, a user on the ladder, a user entering the ladder, and a user off the ladder all can perceive whether the ladder is properly loaded and/or whether the loading on the ladder is becoming unsafe. In turn, one or more users can take action to prevent or address the unsafe loading condition.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
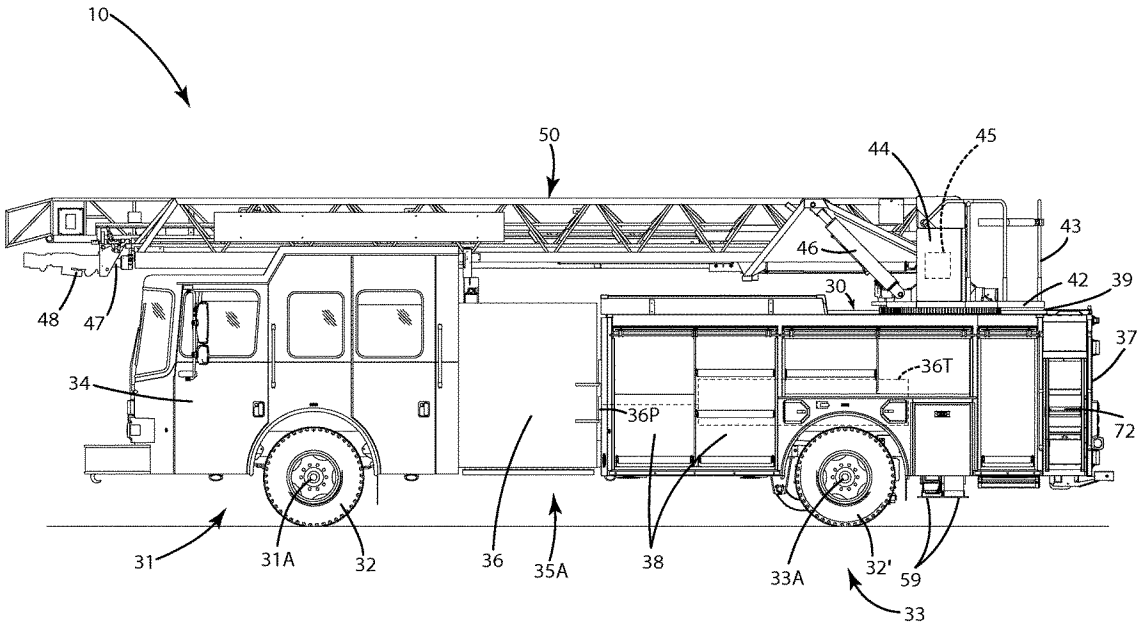
FIG. 1 is a first side view of an aerial firefighting or rescue apparatus in the form of a fire truck including at least one of a rung alignment status indicator and a load status indicator according to current embodiment.

A current embodiment of an aerial firefighting apparatus is illustrated in FIGS. 1-12 and generally designated 10. As shown there, the aerial firefighting apparatus is in the form of an aerial ladder fire truck. Although referred to as an aerial firefighting apparatus, as used herein, that term can also include a variety of emergency vehicles, rescue vehicles and other modes of transportation such as aerial ladder trailers or other equipment. Generally, the aerial ladder apparatus, referred to herein as a fire truck, can be a self-propelled vehicle including a ladder 50. The ladder can be mounted on a frame 30 of the fire truck via a rotatable turntable 40.

The frame 30 of the fire truck 10 can be mounted to a chassis which can be further mounted to multiple wheels 32. The wheels can be attached to conventional front and rear axles, which are further attached to the chassis of the truck. The fire truck can be mobilized via an internal combustion engine which drives the wheels via a transmission.

The fire truck 10 can include one or more internal electronic or computer controls that can operate the engine, transmission, or steering control mechanism to enable the front wheels to be steered upon transport to an emergency location. As used herein, an emergency location can be a scene of a traffic accident, a boating accident, a plane accident, a man-made or natural disaster, and/or a terrorist attack, or any other location where one or more victims' lives are endangered or otherwise compromised.

The frame 30 can include a forward portion 31 and a rearward portion 33 located at opposite ends of the fire truck 10. Generally the rear wheels 32' and their axle are located in the rearward portion 33 of the fire truck 10. The front wheels 32' can be located in the forward portion 31 of the fire truck. The frame 30 in the forward portion 31 can include a cab 34. The cab 34 can house occupants, such as firefighters or rescue personnel, as they are transported to and from an emergency location. The cab 34 can include conventional controls, such as a steering mechanism and various displays inside the cab to monitor and evaluate the operation of the vehicle 10. The cab can terminate a distance of several feet rearward of the front wheels 32, or generally forward of the pump controls and/or rearward portion 33 of the fire truck 10.

The wheels 32, 32' can be mounted on one or more axles, for example a front axle 31A and a rear axle 33A. The front axle can be located in the forward portion 31 and the rear axle can be located in the rearward portion 33. The front axle can include a steering system to enable the front wheels to be steered. The rear axle can have one or more drive components to assist in propelling the truck 10. The rear axle can be joined with a transmission of the vehicle with a drive shaft (not shown).

Although shown with a single rear axle 33A, the apparatus or truck described herein can include multiple rear axles. In such a construction, the side stack hose bed can extend over multiple rear axles. Further, the turntable can be located generally above and rearward of the forwardmost version of the rear axle.

On the frame, behind the cab 34, a pump control panel 36 can be mounted. Under or behind the pump control panel 36, one or more pumps (36P) can be mounted. These pumps can be mounted to the frame. Generally, the pumps can be in fluid communication with a firefighting fluid tank (36T) mounted to the frame in the rearward portion 33 and/or a source of firefighting fluid external to the truck, such as a fire hydrant. The pumps also can be in fluid communication with one or more hoses or waterways 47 as described below. The pumps can be configured to convey firefighting fluid from the external source or the tank to the waterways 47 in a forced manner so that the firefighting fluid can be applied to a fire.

Figure 2:
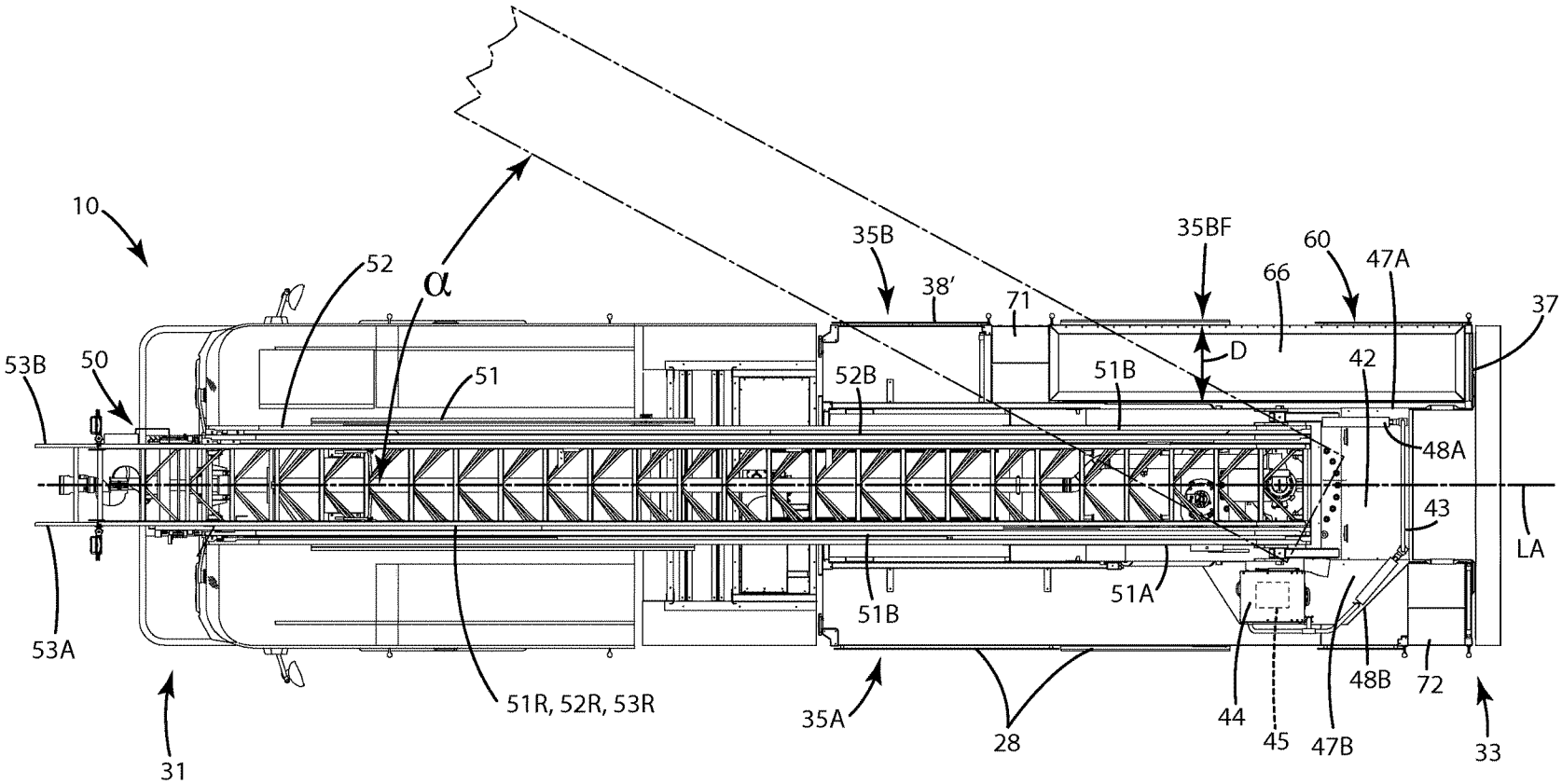
FIG. 2 is a top view of the apparatus with the aerial ladder shown in a stored mode shown in solid lines and in a raised mode shown in broken lines.

The frame 30 can include first lockers 38 mounted rearward of the pump control panel 36, generally in the rearward portion 33 of the fire truck 10 on the first side or driver's side 35A as shown in FIGS. 1 and 2. These lockers optionally can be located on and accessible from the first side 35A of the fire truck, and can be sized and configured to store supplies and equipment useful for easy access at an emergency location. Multiple lockers can fill a substantial portion of the side 35A in the rearward portion 33. As illustrated, some lockers 38 can be mounted forward of the rear axle 33A, some over the rear axle, and some rearward of the rear axle. Generally, all the lockers on side 35A can be located forward of second side access ladder 72. Further optionally, the lockers 38 can be rearward of the front axle and rearward of the pump control panel 36.

The frame 30 also can include second lockers 38' mounted rearward of the cab 34, generally in the rearward portion 33 of the fire truck 10 on the second side or passenger side 35B as shown in FIGS. 1 and 2. These lockers optionally can be located on and accessible from the second side 35B of the fire truck, and can be sized and configured to store supplies and equipment useful for easy access at an emergency location. Optionally, the second lockers 38' can be located substantially only forward of the rear axle 33A. Further optionally, the second lockers 38' can be rearward of the front axle 31A and rearward of the cab 34.

Figure 4:
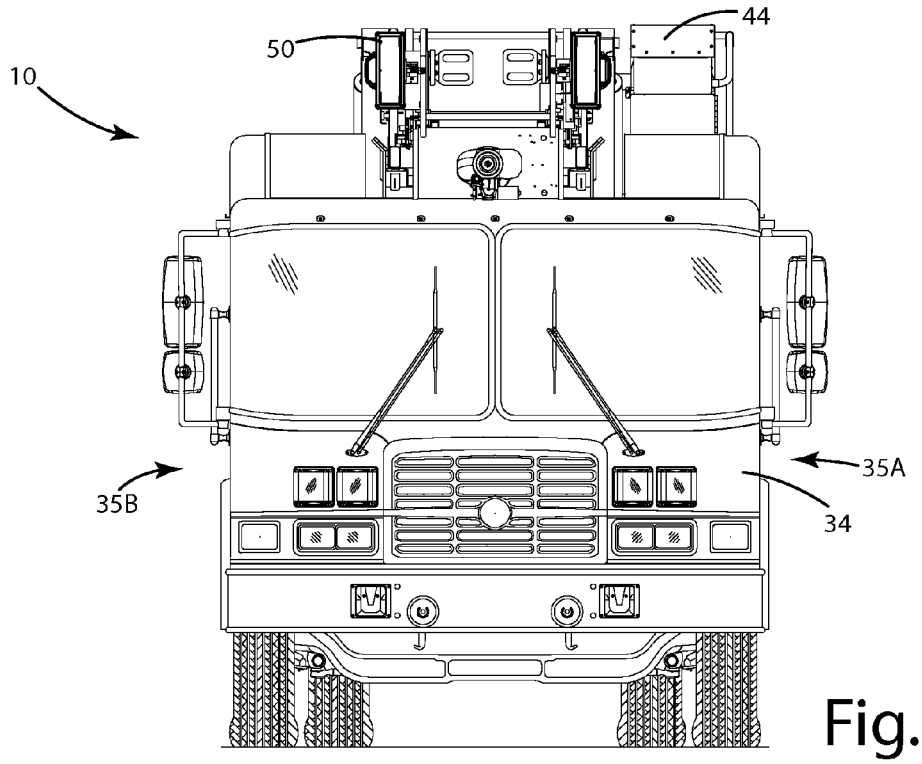
FIG. 4 is a front view of the aerial firefighting apparatus with the aerial ladder shown in the stored mode.

As shown in FIGS. 1, 2 and 4, the fire truck and frame 30 can include an upper deck 39 on which the aerial ladder 50 is mounted. The aerial ladder 50 can be mounted directly to the turntable 40, which is rotatably mounted to the upper deck and/or frame. The turntable can be configured to pivot or rotate the ladder 50 and its sections to a predetermined angle $\alpha$ relative to the longitudinal axis LA of the truck 10, as shown in FIG. 2. Generally, the turntable 40 enables the aerial ladder 50, when raised from a generally horizontal stored position, to pivot through a variety of different orientations relative to the longitudinal axis LA of the truck. The turntable 40 can include its own control console 44 and adjacent the ladder 50. The controls on the console 44 can enable an operator to control the rotation or pivoting of the turntable 40 throughout a range of angles relative to the longitudinal axis LA, and optionally the extension and retraction of the aerial ladder 50, the raising and lowering of the ladder 50.

The turntable 40 can include an access platform 42 attached thereto. The access platform 42 can extend rearwardly from the aerial ladder 50 a preselected distance sufficient to enable a user to attain a firm footing thereon before engaging or disengaging the ladder 50. This platform optionally can be in the form of a plate connected to the turntable. The plate can be rigid enough and/or supported by underlying structure to support the weight of multiple users on the platform.

The access platform 42 can extend laterally away from the longitudinal axis LA and can provide access to the control console 44 including controls of the turntable and/or ladder as desired. The access platform 42 can be configured to include one or more primary safety rails 43 that extend upwardly from the access platform 42 a preselected distance. These rails can prevent accidental departure from the access platform and/or turntable during operation or use thereof. Generally, the primary guide rails 43 can be of a rigid construction made, for example from a tubular steel member. The primary guide rails 43 can be outfitted with one or more secondary guide rails 48A and 48B. These secondary guide rails can be movably coupled to the primary guide rail 43. Generally, they can be in the form of a strap, web, chord, rope, cable, bar, tube or other structure that can be readily rolled, moved, pivoted or otherwise removed to gain access to the access platform 42. Although shown as being a relatively large access platform, the size of the platform can be reduced depending on the particular application and the size of the aerial ladder and/or truck on which it is used.

As shown in FIG. 2, the access platform 42 can include a first entry portion 47A and a second entry portion 47B. The first entry portion 47A can provide access from the access platform 42 to the cover 66 of the side stack hose bed 60. The second entry portion 47B can provide access to the access platform 42 via the second side access ladder 72.

Optionally, the entry portions 47A and 47B can be selectively obstructed by the secondary guide rails 48A and 48B, respectively. The precise obstruction location can depend on the location and orientation of the aerial ladder 50 relative to the respective side access ladders, as further described below. For example, when the aerial ladder 50 is in the position generally shown in FIG. 2, access can be gained to the access platform 42 and generally the aerial ladder 50 via the first side access ladder 71 as well as the second side access ladder 72. Accordingly, in this situation, one or both of the secondary guide rails 48A, 48B can be moved out of the way to provide such access.

As mentioned above, the frame 30 can include a first side 35A and a second side 35B located opposite one another. Generally, the turntable 40 can rotate the ladder 50, optionally when it is out of its generally horizontal stored position, outward beyond one of the sides 35A or 35B and at an angle relative to the longitudinal axis LA, as shown in FIG. 2.

Figures 7, 7A:
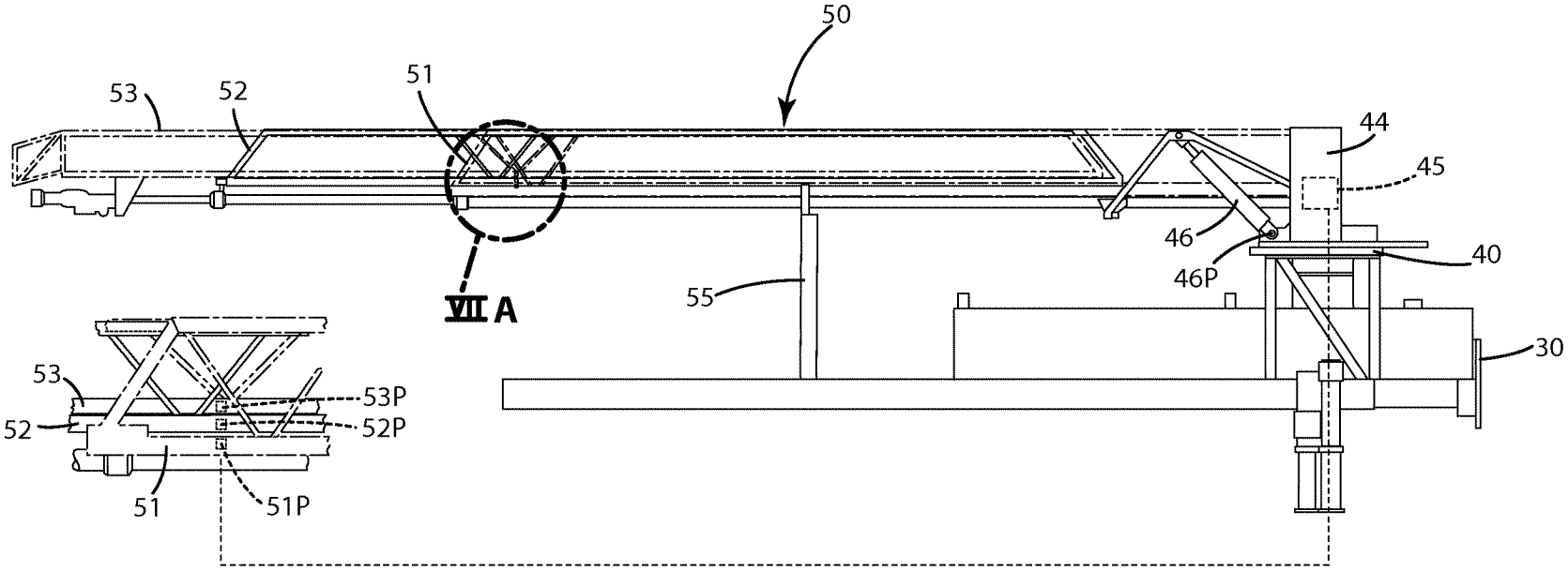
FIG. 7 is a side view of the aerial ladder with rungs of different ladder sections aligned.
FIG. 7A is a close-up view of the aerial ladder with the rungs of different ladder sections aligned.
Figures 8, 8A:
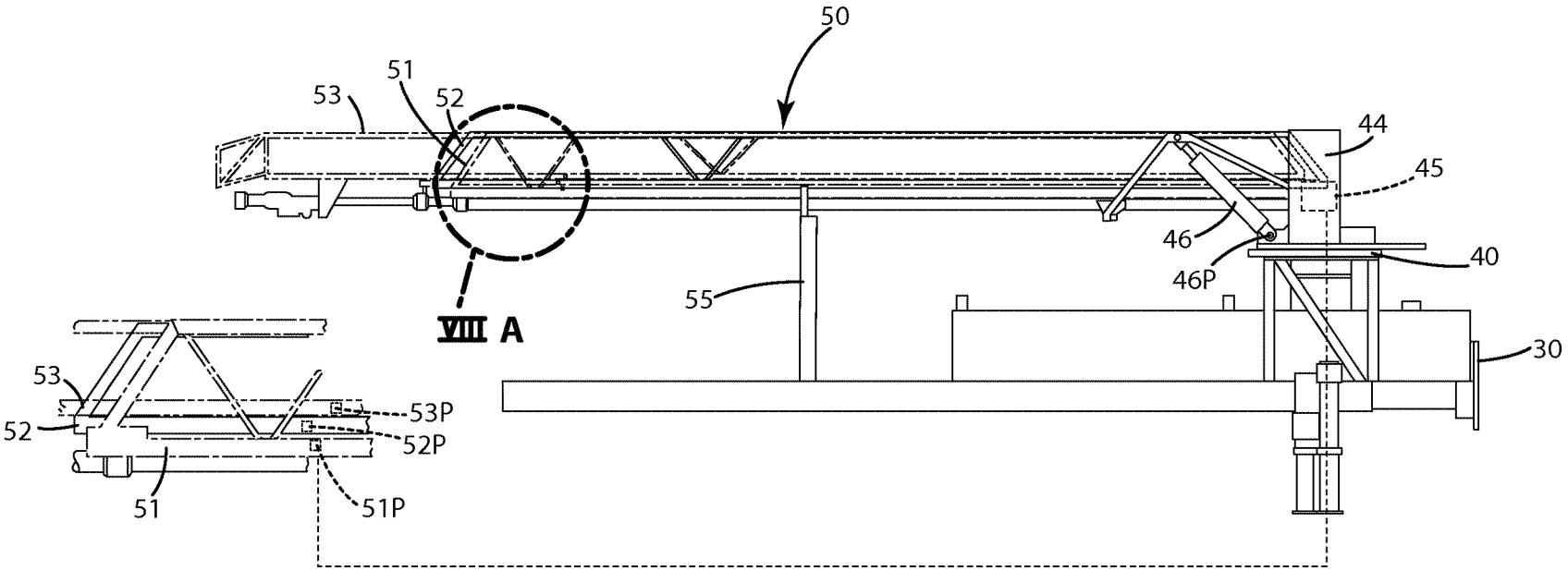
FIG. 8 is a side view of the aerial ladder with rungs of different ladder sections misaligned.
FIG. 8A is a close-up side view of the aerial ladder illustrating the rungs of different ladder sections misaligned.

The ladder 50 can include multiple ladder sections that can be extended and retracted, and/or raised and lowered. As shown in FIGS. 1, 7 and 8, the ladder 50 can include a base or lower or first section 51, a middle or second ladder section 52 and an upper or third (optional) ladder section 53. Of course, although three ladder sections are illustrated, any number of ladders or sections can be utilized. Further, the arrangement and connection of the ladder sections to one another can be varied depending on the application.

The ladder sections 51, 52 and 53 can be movably joined with one another so that the entire ladder 50 can be extended and retracted by moving the ladder sections 51, 52 and 53 with respect to one another. As an example, the ladder base section 51 is movably joined with the second ladder section 52 which is itself movably joined with the second upper ladder portion 53. Optionally, the ladder sections can be coupled to one another so that as the ladder generally extends, each of the ladder sections 52 and 53 move relative to one another and optionally relative to the base section 51.

The base or first section 51, also referred to as a base, can be fixedly and pivotally mounted to the turntable 40. The base section 51 can pivot up and down about a pivot axis PA (FIG. 6) that is generally horizontal. The aerial ladder can be raised and lowered under the power of a ladder raising and lowering mechanism 46. This mechanism 46 can be mounted between the turntable 40 and the aerial ladder 50, optionally directly mounted to the base 51. The mechanism 46 can be in the form of one or more hydraulic rams in fluid communication with a source of pressurized fluid that is operable to raise and lower the ladder 50 from the generally horizontal stored position to a raised position. The ladder can be extended, and in particular the second and third sections 52 and 53 can be extended relative to the first section 51, via utilization of other hydraulic rams (not shown) that operatively connect a pair of the ladder sections. The turntable 40 also can be in communication with the source of pressurized fluid so that the turntable and aerial ladder can be rotated under hydraulic force to extend out one or more sides 35A, 35B of the truck 10. Of course, other non-hydraulic mechanisms can be used to move the ladder and its components, such as electric motors, pneumatic mechanisms, or others depending on the application. Generally, the ladder raising and lowering mechanism 46 and the turntable 40 can be cooperatively operated to lift and rotate the ladder 50 out of a generally horizontal stored position to a variety of other operative positions and angles, and vice-versa.

As shown in FIGS. 1 and 2, the first section 51 of the ladder can include a channel shaped cross-section. With this construction, the first section 51 can be substantially reinforced and rigid. Optionally, the base can be constructed from steel and/or other extremely rigid alloys or metal, and further optionally, not constructed from aluminum or other soft metals. The base 51 further can be reinforced with a variety of reinforcing lattice 51L or other structure.

The ladder, base and secondary boom can include one or more waterways 47 mounted thereto. These waterways are operable to transfer a continuous supply of firefighting fluid to the water outlet 48 which is generally in the form of a nozzle. Generally, the waterway receives pressurized firefighting fluid from a pump 36P or storage tank 36T on the frame 30. More particularly, the nozzle 48 assists in pressurizing and/or shaping the continuous stream of firefighting fluid from the waterway 47 toward a fire in a burning building, in a vehicle or elsewhere. Generally, the waterway can include multiple rigid, tubular sections that telescope and slide relative to one another. Optionally, the waterways can become progressively smaller, closer to the water outlet 48.

The waterways 47 can be disposed along and extend the length of the ladder 50. The waterways are maintained in close proximity to (and usually under) the ladder sections 51, 52 and 53, even as the ladder 50 is moved between extended and retracted positions. The telescoping tubular sections of the waterways can cooperate with one another to provide a continuous fluid passageway along the length of the ladder 50.

Figure 6:
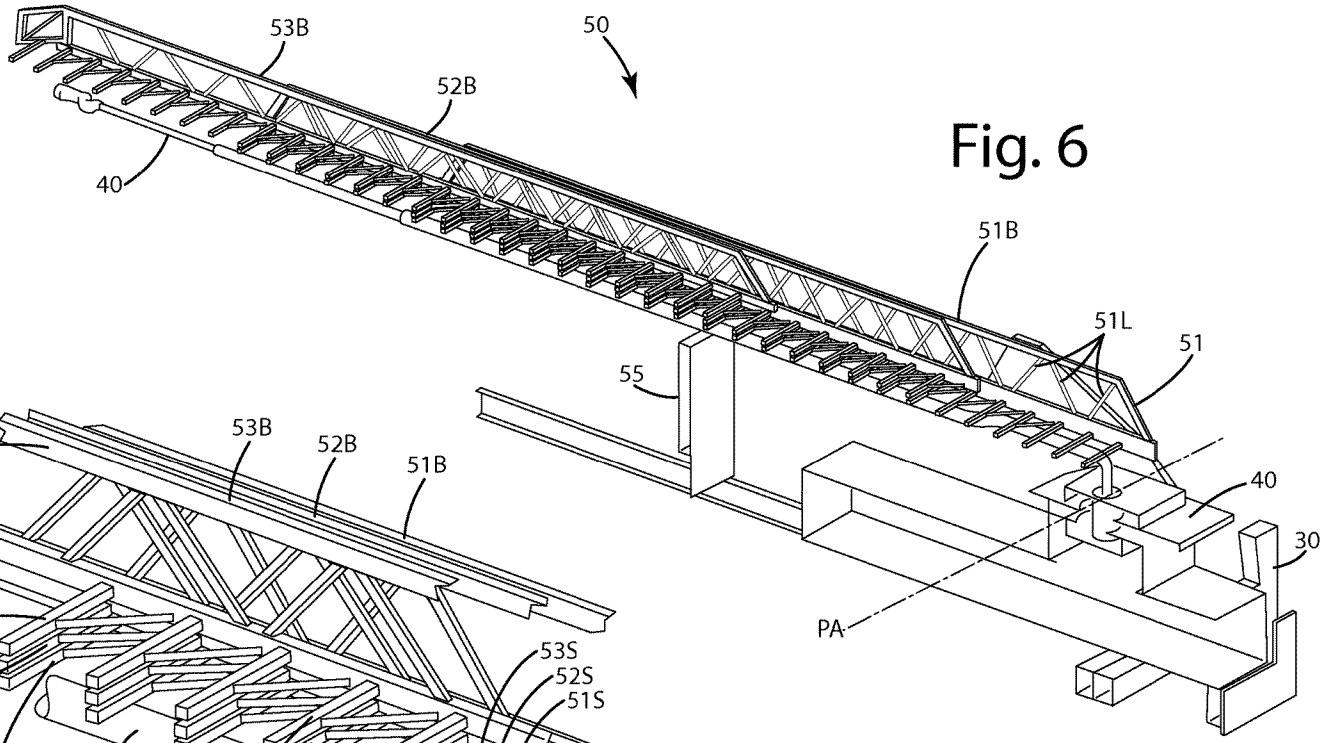
FIG. 6 is a perspective section view of the aerial ladder showing rungs of the different ladder sections aligned.

As illustrated in FIGS. 6-8, the fire truck or frame can include a ladder support 55. When the ladder 50 is in a generally horizontal stored position, the base 51 rests upon the ladder support 55, and optionally a plate or pad mounted atop the support 55. This plate or pad can be of a cushioned material, such as rubber, to absorb vibration and minimize impact between the base 51 and the support 55. Optionally, the ladder support 55 is mounted directly to the frame 30 in a rigid supportive manner. This is so that the immense weight of the ladder 50 can be supported without resting on other structural components of the vehicle, such as the cab 34 or the forward portion 31 of the truck in general. The ladder support 55 supports the ladder 50 and in particular the first section 51, so that it is elevated a preselected distance above the cab 34 when the ladder is in the generally horizontal stored position.

As shown in FIGS. 1 and 2, the fire truck 10 optionally can be outfitted with one or more stabilizer legs 59 that can be operated to extend outwardly from the rearward portion and/or forward portion of the truck to stabilize the truck and prevent it from tipping when the ladder 50 is extended outward at some predetermined angle $\alpha$ relative to the longitudinal axis LA of the truck.

Figure 3:
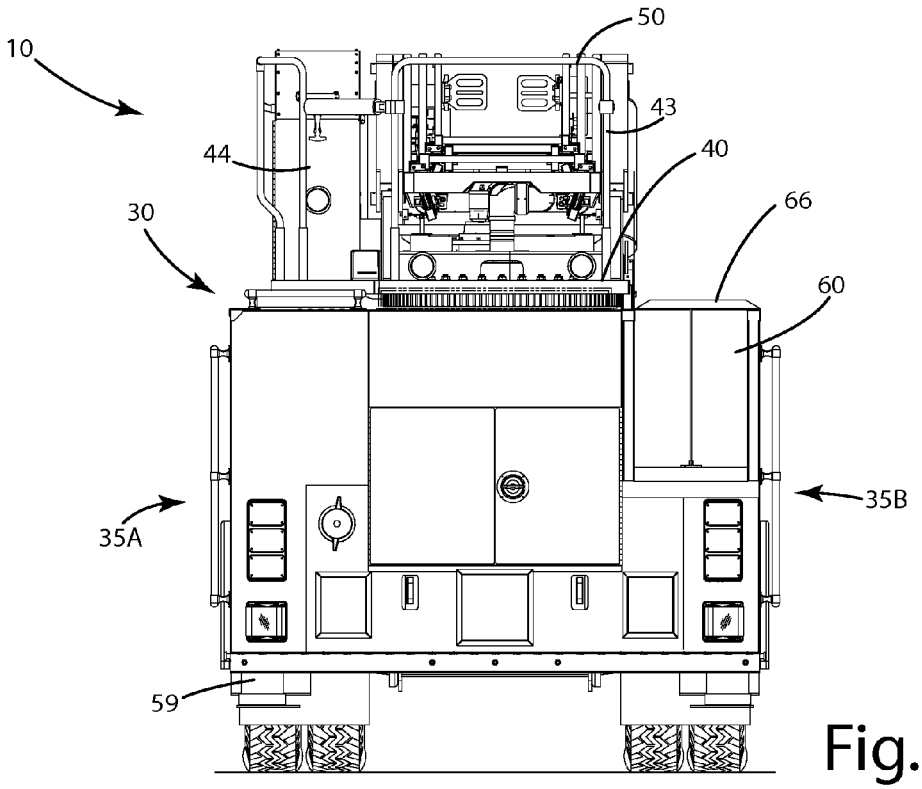
FIG. 3 is a rear view of the aerial firefighting apparatus with the aerial ladder in a stored mode.

As illustrated in FIGS. 2 and 3, the frame 30 can include a side stack hose bed 60. The side stack hose bed can be mounted to the frame 30, optionally in a location laterally displaced toward one of the sides 35A or 35B relative to the longitudinal axis LA of the fire truck. The side stack hose bed 60 can extend from an outer side face 35BF a distance D (FIG. 2) from the ladder 50. The preselected distance D can be sufficient to store a desired amount of flexible fire hose. Generally, the side stack hose bed is configured to form a container in which the hose can be temporarily stored. The hose can be folded upon itself multiple times with the greater lengths of the hose running from the rear 37 of the truck toward the forward portion 31 of the truck.

As shown in FIG. 2, the side stack hose bed can be located substantially only in the rearward portion 33 of the truck 10. The hose bed 60 can extend from the rear 37 to a location over the rear axle 33A and up to the first side access ladder 71. In some cases, this hose bed can extend beyond that location and more toward the pump discharge 36D and/or front axle 31A. Of course, with a hose bed being extended accordingly, the space for the lockers 38' can be consumed.

As shown in FIG. 2, the side stack hose bed 60 includes a side stack hose bed cover 66. This cover generally includes a substantially horizontal (when the vehicle is on level ground) rigid, elongated plate. The elongated plate can be outfitted with a diamond plate or a tread pattern to provide enhanced traction when a user traverses the cover 66. The cover 66 can be reinforced with an underlying lattice, frame or other structure to provide enhanced rigidity and prevent buckling under excessive loads. The side stack hose bed cover 66 is illustrated as a single cover extending over the bed 60.

With reference to FIG. 2, the cover 66 can be configured to provide ingress and egress to and from the ladder 50 generally from the platform 42 to the side access ladder 71. More particularly, a user can take a path to and from the ground by traversing up the side access ladder 71 across the cover 66 and to the access ladder platform 42 and/or turntable 40 to access the ladder 50. In general, the side stack hose bed cover can be configured to enable a user to traverse from the side access ladder to the access platform, generally over the side stack hose bed cover 66. Further, the side access ladder provides access to the side stack hose bed cover 66 to enable a user to further access the access platform 42 and/or the ladder 50.

The optional first side access ladder 71 can provide a path from a ground location toward the side stack hose bed cover. The hose bed cover 66 then provides the further path to the access platform 42, and in particular, one or more of the entry portions 47A and 47B, depending on the orientation and angle of rotation of the ladder 50. Optionally, when the ladder 50 is disposed generally perpendicular to the longitudinal axis, the access platform 42 extends outwardly over the cover 66. The entry portion 47A is aligned generally parallel to the length of the cover 66. In this manner, users can quickly walk on and off the access platform 42 via the cover 66. From there, the side access ladder 71 provides vertical access to and from the ground adjacent the truck 10.

The truck 10 also can include at least one additional optional second side access ladder 72 as shown in FIG. 1. This ladder can be generally identical to the first side access ladder and can include the same features. However, the second side access ladder is mounted in the rearward portion 33 of the vehicle as shown in FIG. 2, rearward of the lockers, pump controls and other apparatus on the side 35A of the truck. Further, the second side access ladder 72 generally can be disposed and located rearward of the rear axle 33A and/or rear wheels 32'. This can provide a slightly varied location for entrance for ingress and egress to the turntable and/or access platform 42. Generally, the ladder is mounted immediately adjacent the rear corner 37C of the truck without extending onto the rear 37 of the truck. Of course in some implementations, it can be tilted at an angle 45° relative to the longitudinal axis LA to provide varied access to the platform from the rear corner and/or rear of the truck.

Figure 5:
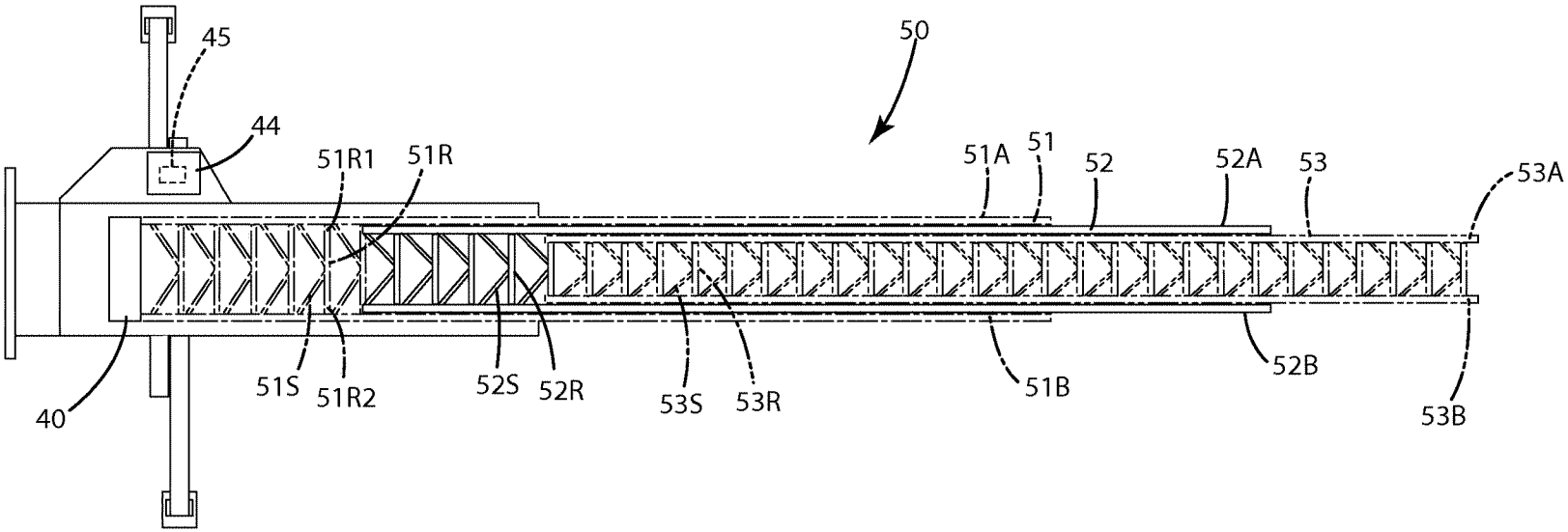
FIG. 5 is a top view of the aerial ladder shown with the rungs of different ladder sections aligned.
Figure 6A:
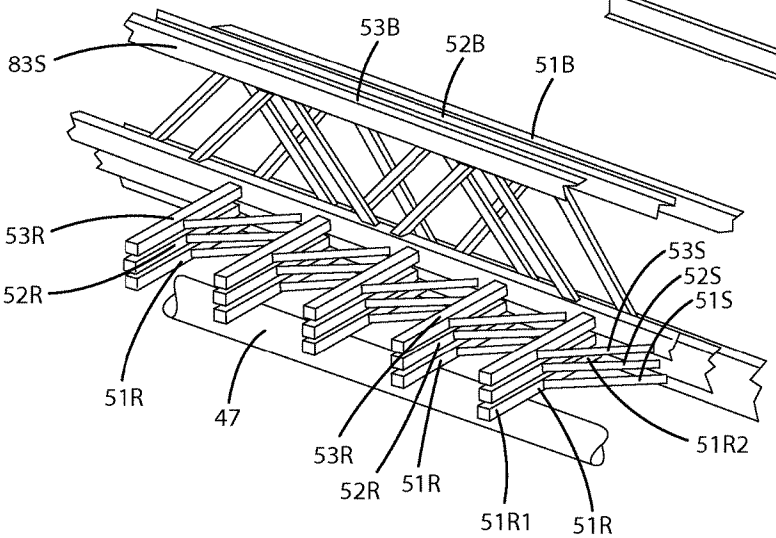
FIG. 6A is a close-up view of the rungs of the different ladder sections aligned, and multiple lighting elements along an elongated lighting strip.

As shown in FIGS. 2, 5, 6 and 6A, the first ladder section 51, second ladder section 52 and third ladder section 53 each can include their own plurality of rungs 51R, 52R, and 53R. Each of the rungs 51R, 52R and 53R can include first and second ends, for example, 51R1 and 51R2 (FIGS. 5 and 6A). These first and second rung ends 51R1 and 51R2 can form the opposing ends of each of the respective rungs. The rungs can form a surface upon which a user can place their foot for support and to provide a step to another rung. Optionally, each of the rungs can be coated with an anti-slip or traction-enhancing material, or otherwise outfitted with an adhesive backed anti-slip or traction-enhancing sticker, laminate or substrate. In other cases, the rungs can be constructed from metal that is knurled to provide the enhanced traction, particularly when the ladder becomes wet during a firefighting operation. The rungs themselves can be constructed from a metal, polymeric and/or composite structure that is solid or tubular. The rungs can be of a circular cross-section, but other cross-sections can be selected depending on the application as desired.

As shown in FIGS. 5-6A, each of the plurality of rungs 51R, 52R and 53R on the different ladder sections can include reinforcement supports 51S, 52S and 53S. The reinforcement supports can extend from each of the opposing first and second side rails, for example 51A and 51B, or 52A and 52B, or 53A and 53B of each respective ladder section and connect with a central portion of each of the rungs. This central portion can be about midway between the first and second side rails of the respective ladder section. This semi-lattice or trussed structure can provide enhanced support and can enhance the structural integrity of each of the respective rungs.

The first ladder section rungs 51R, second ladder section rungs 52R and third ladder section rungs 53R can be of varying lengths relative to one another. For example, the third ladder section 53 plurality of rungs 53R can be narrower or shorter than the plurality of rungs of the first and second ladder sections 51 and 52, respectively. As an example, the third rungs 53R can be about 3 inches to about 6 inches shorter than the second plurality of rungs 52R. The second plurality of rungs can be about 3 inches to about 6 inches shorter than the first plurality of rungs 51R. Accordingly, the ladder sections can include sequentially increasing rung lengths from the first ladder section to the second ladder section and to the third ladder section.

Optionally, the above noted differences in rung lengths can affect the orientation of the side rails 51A, 51B relative to side rails 52A, 52B and 53A, 53B. For example, with the rungs of the second ladder section 52 being shorter than the rungs of the first ladder section 51, the first and second side rails 52A and 52B of the second or middle ladder section 52 can fit between the first 51A and second 51B side rails of the first ladder section 51. Where the optional third or upper ladder sections included, the first 53A and second 53B side rails of this ladder section 53 can fit between and generally be narrower than, the side rails 52A and 52B of the second or middle ladder section 52. With this construction, the third ladder section can be nested and moveably or slideably disposed within the side rails of the second or middle ladder section. Likewise, the second or middle section side rails can be nested and slideably disposed within the side rails of the first or base section 51. In this manner, space can be efficiently utilized to include multiple sections of ladder that are telescopically joined with one another.

Figure 9:
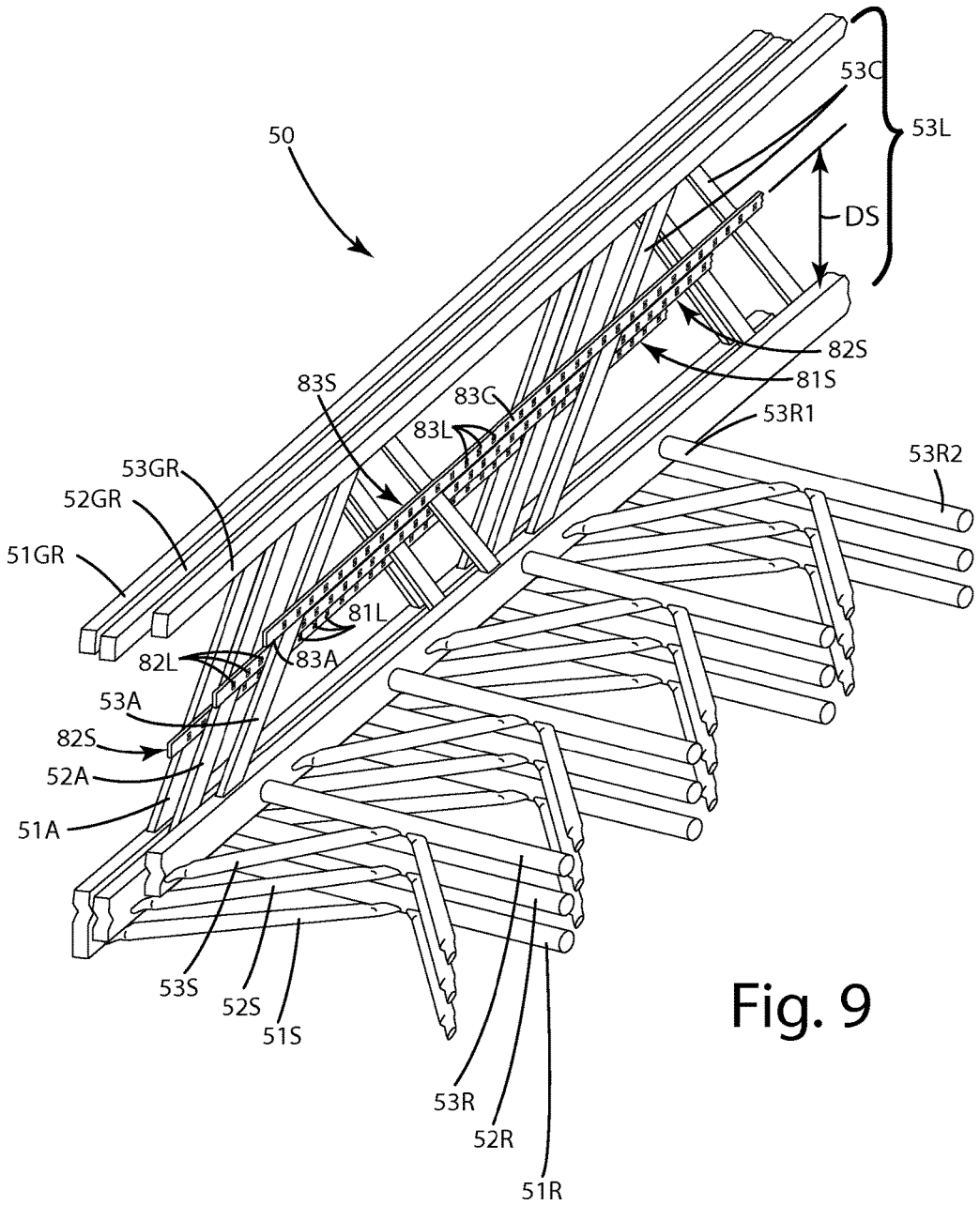
FIG. 9 is a perspective view of the aerial ladder and multiple rung alignment status indicators and/or load status indicators extending along side rails of the various ladder sections of the aerial ladder; with the rung alignment indicator and/or load status indicator selectively illuminated in a safe mode.

As mentioned above, each of the ladder sections 51, 52 and 53 can include respective first and second side rails. As shown in FIGS. 6 and 9, the side rails 51A, 52A, 53A can generally include a base rail 51BS, 52BS and 53BS, respectively. Each of these base rails can join directly with the respective rungs, and optionally to the reinforcement supports of the respective sections. The base rails 51BS, 52BS, 53BS can also include a lattice or side wall structure 53L extending upwardly therefrom and away from the rungs. This structure and the base rail will be described primarily in connection with the third ladder section, but it will be appreciated that these structures apply equally to the first ladder section 51 and second ladder section 52.

Generally, the sidewall structure 53L can include one or more cross members 53C that extend from the base 53BS upward to a top or guide rail 53GR. As shown, the cross members 53C optionally can form a truss configuration. This can add to the rigidity and strength of the side rails 51A, 51B, 51A, 52B and 53A, 53B. Of course if desired, the truss system can be replaced with a single continuous piece or sheet of reinforced material extending from the respective guide rails 51GR, 52GR, 53GR down to the respective base rails 53BS, 52BS and 51BS. Other structures can be replaced for either of these configurations as well, depending on the particular application.

The guide rail 51GR can be spaced from the base rail 53BS about 6 inches to 24 inches, or about 12 inches to about 18 inches, or other distances depending on the desired application. Generally the guide rails 51GR, 52GR and 53GR as shown in FIG. 9 can provide added safely to occupants or users of the ladders. For example, in many cases, the guide rails and their respective side rails can prevent a user for inadvertently stepping beyond the rungs. They also can provide an area to grasp by the user when climbing or descending the respective ladder sections.

Figure 10:
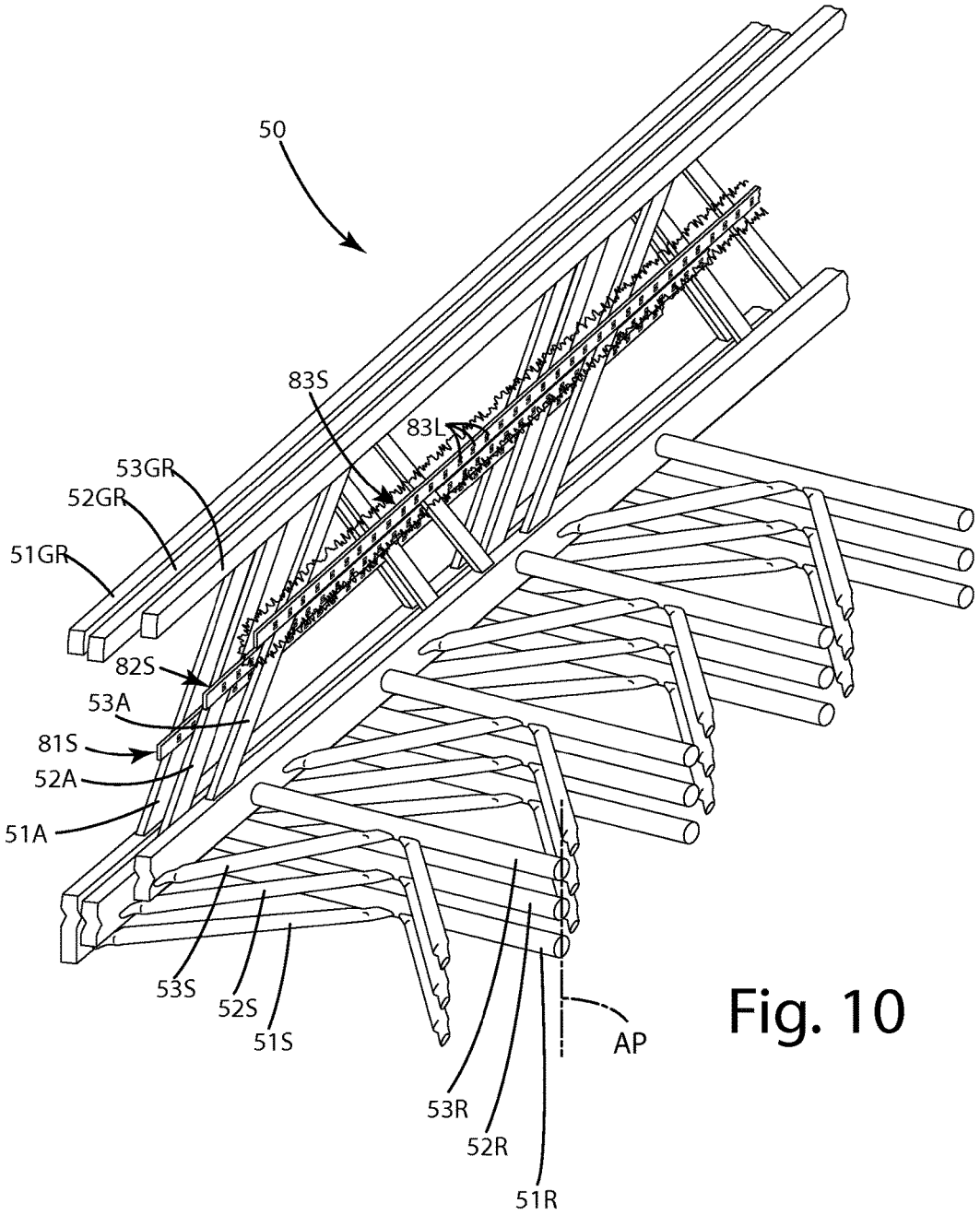
FIG. 10 is a perspective view of the aerial ladder with the rung alignment status indicator and/or load status indicator selectively illuminated in another type of safe mode.
Figure 11:
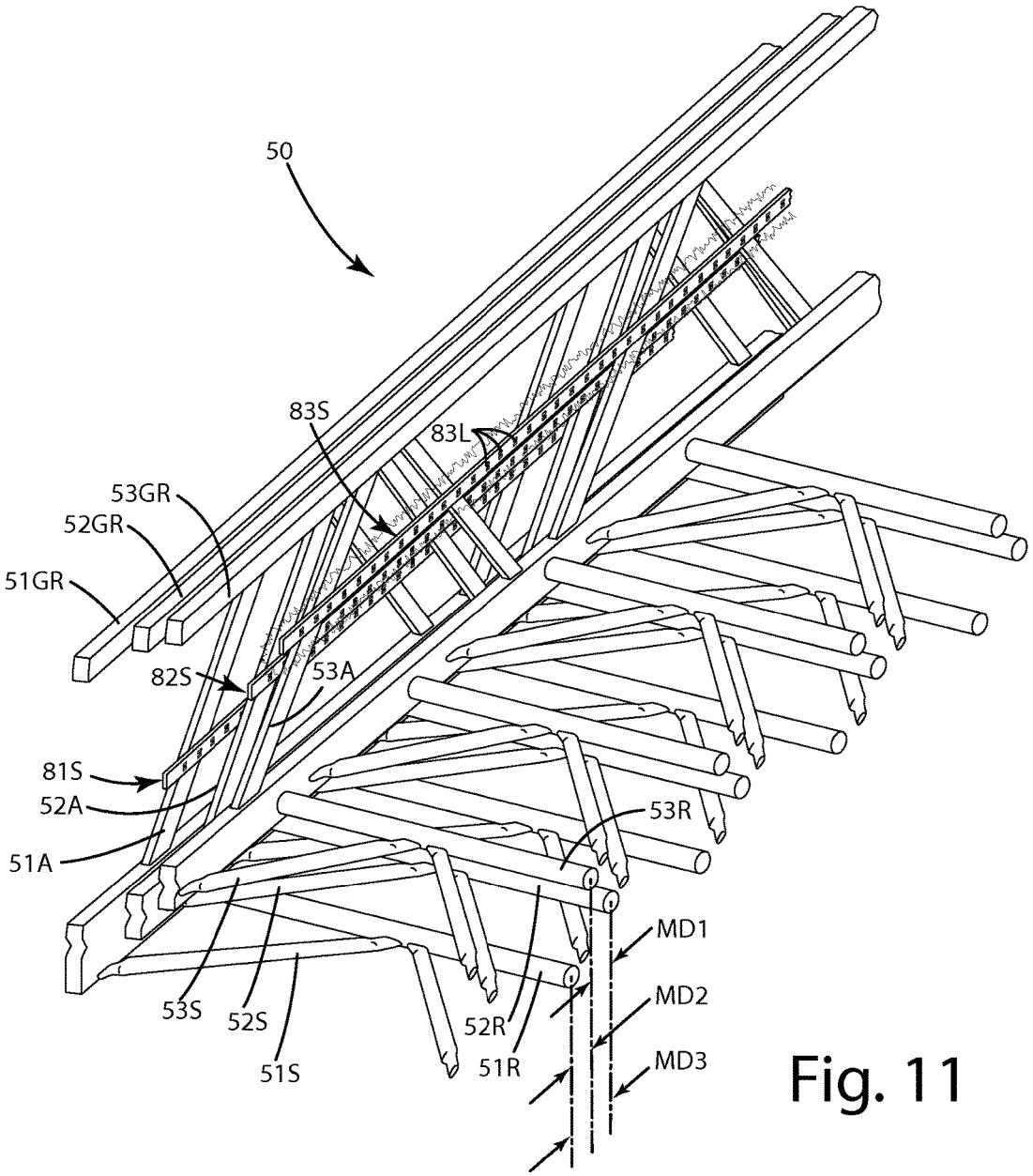
FIG. 11 is a perspective view of the aerial ladder with the rungs misaligned and the rung alignment status indicator selectively illuminated in a warning mode.

As mentioned above, the apparatus 10 can be outfitted with one or more status indicators in the current embodiments. Generally, these status indicators can be in the form of one or more lighting strips 81S, 82S and 83S, as shown in FIGS. 9-11, for example. These lighting strips can be aligned along the respective side rails 51A, 51B, 52A, 52B, 53A and/or 53B. Optionally the lighting strips 81S, 82S and 83S can be disposed on opposite side rails of each of one or more of the ladder sections 51, 52 and 53.

The description of the lighting strip 83S here applies equally to those of the strips 82S and 81S. The lighting strip 83L can include multiple individual lighting elements 83L. These lighting elements 83L can be disposed on a lighting support 83A. The lighting support 83A can form an elongated strip or length of supportive material. As an example, the lighting support 83A can be in the form of a C-shaped metal, polymeric and/or composite channel. The channel can be outfitted with one or more heat sinks for the lighting elements if desired. The strip 83S can attach directly to the side rails 53A, 53B of the ladder section 53. Of course, the other lighting strips 82S and 81S can be likewise attached to the respective side rails of the other ladder sections. The strip 83S also can include a protective cover 83C (FIG. 9). This cover generally covers the individual lighting elements 83L. The cover 83 can be constructed from a transparent and/or translucent material to allow light emitted from the respective lighting elements 83L to be visualized or perceived by a user.

The lighting strips 81S, 82S and 83S can be attached to one or both side rails as mentioned above. This can provide enhanced illumination of the rungs on each respective ladder section. Of course, if desired, the strips can be attached only to a single side rail, for example a left side rail or a right side rail. Optionally, the lighting elements can be attached to left or right side rails to provide different information to a user of the ladder via selective illumination thereof.

Although referred to herein as a lighting strip, this component and the respective multiple lighting elements can be incorporated directly into the side rails. As an example, the side rails can include apertures with lights visible through the apertures (not shown). Alternatively, the lighting strip can be in the form of an elongated wire with multiple lighting elements connected to one another, with the wire secured to the base rail, guide rail and/or cross members of the respective side rails. Further, although shown with a multitude of lighting elements, the strip can be outfitted with a lesser or greater number of lighting elements, depending on the particular application, the intensity of the particular lighting elements and the desired lighting on the ladder.

Optionally each of the lighting strips 81S, 82S and 83S can be in electrical communication with a power source and an electronic control system 45, which can be a computer, processor and/or control module 45. This control module 45, also referred to as a controller, can optionally be mounted in the control tower 44 or elsewhere on the frame 30.

The lighting strips can be disposed a distance DS (FIG. 9) that is close enough to the rungs to provide illumination thereto, optionally when the status indicator is in a safe mode. The distance DS can also be sufficiently distal from the base rails 51BS, 52BS and 53BS and the respective rungs 51R, 52R and 53R so that a user cannot inadvertently step on or otherwise damage the respective strips 81S, 82S and 83S. In some cases, although shown on the interior of the respective side rails, the lighting strips can be alternatively placed on the opposite or outermost portions of the side rails.

The individual lighting elements 81L, 82L, 83L of the current embodiments can be in the form of lighting emitting diodes (LEDs) or organic light emitting diodes (OLEDs). Of course, other types of lighting elements can be substituted for the aforementioned elements, for example, incandescent lighting elements, halogen lighting elements, or others. The LEDs can be joined along the support or bar 83A with a common wire or wires so that power conveyed through the wire or wires selectively illuminates all or a portion of the LEDs. This wire can be further joined with the controller 45 as is described in further detail below. The multiple lighting elements can be of a single color, such as white, amber, red, blue, yellow, green or the like. Alternatively, the lighting elements 83L can be mixed and matched to include a variety of different colored lights on a single support 83A. The respective different colored lights can be selectively illuminated to indicate one or more types of warning mode and/or safe modes, depending on the application.

The lighting strips 81S, 82S and 83S can all be consistently and simultaneously illuminated with the same color or colors in each of the respective modes. For example, the first ladder section 51, the second ladder section 52 and third ladder section 53 can all be illuminated with a preselected first color (e.g., blue) illumination emitted via the respective lighting strips 81S, 82S and 83S to indicate that the ladder is in a safe mode with regard to rung alignment and/or loading as described in further detail below. As another example, the first ladder section 51, the second ladder section 52 and third ladder section 53 can all be illuminated with a preselected second color (e.g., amber) illumination emitted via the respective lighting strips to indicate that the ladder is in a warning mode with regard to rung misalignment and/or unsafe ladder loading as described in further detail below. Alternatively, the safe mode and the warning mode can be indicated via the strips being constantly illuminated (safe mode) and pulsing or blinking (warning mode).

As mentioned above, the status indicator can be a rung alignment status indicator and/or a load status indicator. Generally either or both of these status indicators can be in the form of the lighting strips 81S, 82S and 83S combined with the respective ladder sections and including multiple lighting elements joined therewith. The strip and/or lighting elements are visible and visually perceivable when selectively illuminated by any user who is located on or about to enter the ladder and/or the ladder sections. In many cases the strip and lighting elements emit so much illumination, they also may be visible to bystanders near the apparatus.

The strip and/or lighting elements can be selectively illuminated to indicate rung alignment status and/or load status in different modes. For example, when the status indicator is in the form of a rung alignment status indicator and the rung alignment status indicator is in a first warning mode, the lighting elements of the respective lighting strips 81S, 82S and 83S are selectively illuminated so that a user located on or about to enter the ladder from its lowermost portion can view those illuminated lighting elements and understand that the rungs are misaligned and therefore could present an inadequate or unsatisfactory foothold for the user stepping on the rungs. As another example, when the ladder is overloaded beyond a preselected load capacity or approaches a preselected load capacity, the lighting elements of the respective lighting strips 81S, 82S and 83S can be selectively illuminated in a second warning mode so that a user on or about to enter the ladder can understand and perceive that the load on the ladder 50 is safe or unsafe. Based on this perception, the user can enter the ladder and proceed up it, or not enter the ladder because the loading capacity is such that it could threaten to tip or overturn the fire truck 10 with an increased load. Each type of status indicator will now be described.

The rung alignment status indicator can include the lighting strips 81S, 82S and 83S and multiple lighting elements 81L, 82L and 83L as described above. These lighting elements can be in communication with the controller 45. The controller 45 can control and selectively illuminate the respective lighting elements 81L, 82L and 83L of the respective lighting strips 81S, 82S and 83S. Generally the controller operates the rung alignment status indicator during a first warning mode and/or a first safe mode.

The lighting routine in the first safe mode can vary. For example, in one safe mode of the rung alignment status indicator, the individual lighting elements 81L, 82L and 83L all can be simultaneously illuminated when the ladder is in general use. In this first safe mode, the lighting strips 81S, 82S and 83S can provide constant illumination of the ladder sections to enhance a user's visual perception of the respective rungs. More particularly, the strips 81S, 82S and 83S in the first safe mode can emit a first color such as blue when the rungs of the different ladder sections are aligned in common alignment planes AP shown in FIG. 10. There, the lighting strip 83S and in particular the multiple elements 83L are selectively illuminated in a first color, for example, blue, under the control of controller 45.

In the first warning mode, preselected ones of the lighting elements 81L, 82L and 83L can selectively change in color, or turn off or on, to indicate that the rungs are improperly aligned. As shown in FIG. 11, in the first warning mode, the controller 45 selectively illuminates the lighting strip 83S and in particular the plurality of lighting elements 83L in a second color, for example, yellow, amber or orange, to indicate to the user that the respective rungs 51R, 52R and 53R of the different ladder sections are misaligned with one another, and likely to present an unsafe foothold for the user.

The rung misalignment is better shown in FIG. 11. There, the third plurality of rungs 53R are offset a misalignment distance MD1 from the plurality of rungs 52R of the second ladder section. Thus, the rungs 52R and 53R are misaligned. Likewise, the rungs 51R of the first ladder section are offset or misaligned a misalignment distance MD2 from the third alignment rungs 53R, and yet another misalignment distance MD3 from the second plurality of rungs 52R. Again, when the rungs are in this misaligned configuration, the rung alignment status indicator can automatically enter the first warning mode with the controller selectively illuminating the lighting strips 81S, 82S and 83S. Incidentally, the lighting strip 83S is shown as being selectively illuminated in FIGS. 10 and 11, however, the other lighting strips 81S and 82S are likewise illuminated, even though not shown.

The rung alignment status indicator, controller and lighting strips can be operated in other routines to indicate safe modes and/or warning modes. For example, the lighting strips 81S, 82S and 83S can be automatically selectively illuminated under the control of the controller, for example, by being "off" or not illuminated in a safety mode to indicate that the rungs are aligned. When the rungs become misaligned, however, the lighting strips 81S, 82S and 83S can illuminate to indicate the warning mode to a user on or about to enter the ladder. Alternatively, the rung alignment status indicator can function so that the lighting strips 81S, 82S and 83S can selectively be illuminated all the time while the system is in a safe mode. As an example, the strips can be illuminated green for "go" when the rungs become misaligned, however, the strips illuminated in green can be turned off (with no other lighting element illuminated), indicating to a user on or about to enter the ladder that the rungs are improperly aligned or misaligned.

The controller 45 controls the rung alignment status indicator, and in particular the multiple lighting strips 81S, 82S and 83S, based on input signals from proximity sensors 51P, 52P, 53P that are located adjacent one or more preselected rungs of the first, second and third ladder sections. As shown in FIGS. 6A and 7A, the first proximity sensor 51P can be disposed generally on or near the first ladder section 51. A second ladder proximity sensor 52P can be disposed on or near the ladder section 52. A third ladder proximity sensor 53P can be disposed on or adjacent the third ladder section 53. Optionally, one or more of the three proximity sensors can be deleted. For example, the third proximity sensor can be deleted, with the alignment of the rungs 53R determined based on the extension of the third section 53 and certain relationships between the movement of the third section relative to the other sections. As another example, there can be a single proximity sensor 52P that senses or detects the rungs 52R of the overlap, alignment or misalignment of the rungs 51R on the base ladder section relative to the rungs 52R middle ladder section. In this case, where these rungs 51R, 52R are aligned, the rungs 53R on the third section also can be aligned due to the mechanical relationship and orientation of the ladder sections relative to one another.

Generally, the proximity sensor can sense or detect when one object is proximal or near another object. In the current embodiments, the proximity sensor can detect when one rung or set of rungs of one section is near or adjacent the rung or set of rungs of another section. For example, with reference to FIGS. 7A and 10, the proximity sensor can detect that the rungs of two or more sections are generally aligned along common alignment plane AP. When this status is detected, the proximity sensor can send signals to the controller 45, which is in electrical communication with the sensor. When the plurality of rungs 51R, 52R and 53R are aligned in parallel, generally in a common plane AP, the rungs of one section do not prevent entry of a foot into the opening above the rungs of another section. The rung reinforcement supports 51S, 52S and 53S also are generally aligned so that they do not interfere with another or placement of a foot onto one of the respective rungs of the different sections.

The proximity sensor can be in electrical communication with the controller or processor 45 which optionally can be mounted in the control console 44. The sensors can operate at a threshold which, when met, can send an "on" or "off" signal to the controller 45 indicating that the rungs of one section are either aligned or misaligned with the rungs of another ladder section. The controller 45 can process these signals and data and operate the rung alignment status indicator to selectively illuminate the multiple lighting elements along the lighting strips 81S, 82S and 83S.

Figure 12:
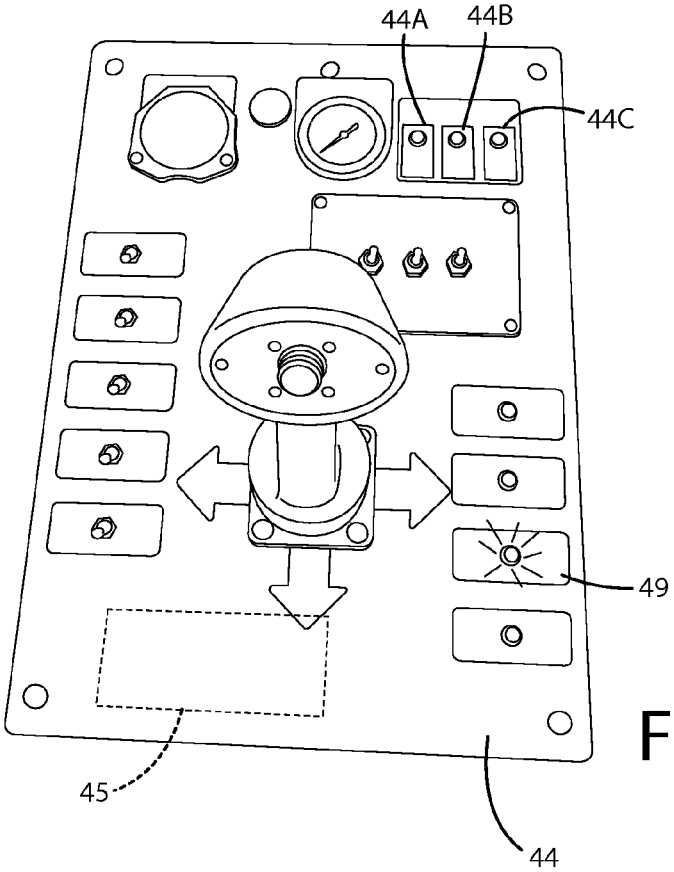
FIG. 12 is a perspective view of a control console of the apparatus including console load lights and console rung alignment lights.

In addition to the illumination of the rung alignment status indicators, and in particular the lighting strips 81S, 82S and 83S, the controller 45 also can be in electrical communication with a console alignment light 49 as shown in FIG. 12. Depending on whether the rungs or aligned or misaligned as detected by one or more proximity sensors and processed by the controller 45, the console alignment light can be selectively illuminated. The console alignment light 49 can be separate and distal from the multiple lighting elements of the lighting strips located on the ladder. The console alignment light can be primarily only viewable by an operator standing adjacent the control console 44. It cannot be easily viewed by a user on or about to enter the ladder except in limited circumstances. Thus, when the rungs are aligned, the controller 45 can selectively illuminate both the console alignment light and the multiple lighting strips to indicate the alignment or misalignment of the rungs.

Optionally, the operator of the control console 44, who controls movement of the ladder 50, can perceive the status of rung alignment based on whether the console alignment light 49 is on or off. In addition, when the operator at the control console 44 views the ladder sections, the operator also can visually perceive the rung alignment status based on the selective illumination of the respective lighting strips, 81S, 82S and 83S. In this manner, the operator can have two sources of input, one from the console alignment light and the other from the lighting strips to visually perceive whether the rungs are aligned or misaligned.

As mentioned above, the truck 10 alternatively or additionally can include a status indicator in the form of a load status indicator. The load status indicator can operate in a second safe mode when the load of the ladder (which includes the load generated by the ladder sections, any occupants and equipment thereon) is within a predetermined range of loads or less than an aerial ladder load rated capacity as described below. The load status indicator also can operate in a second warning mode when the load of the ladder outside the predetermined range of loads, is about to be overloaded and/or exceeds an aerial ladder load rated capacity.

The load status indicator can be in the form of the lighting strips 81S, 82S, 83S with multiple lighting elements that can be selectively illuminated depending on the load status. For example, the lighting strips 81S, 82S, 83S and in particular the individual lighting elements 81L, 82L and 83L can be selectively illuminated depending on one or more factors, such as whether the ladder 50 is about to be overloaded, is overloaded by a certain percentage of its load rated capacity and/or the load rated capacity is exceeded by a particular percentage or amount. The controller 45 can evaluate and analyze these factors, then control operation of the multiple lighting elements 81L, 82L and 83L of the respective lighting strips 81S, 82S, 83S in the different ladder sections to provide visual status output concerning loading on the ladder.

It is noted that the controller 45 can operate the lighting strips 81S, 82S, 83S, when the status indicator is in the form of an alignment status indicator and/or a load status indicator. Optionally, the same lighting elements can be selectively illuminated in the first warning mode and second warning mode when either or both indicators are operational. Further optionally, different lighting elements can be selectively illuminated in the first warning mode and second warning mode when either or both indicators are optional. Even further optionally, if desired, additional separate lighting strips (not shown) can be added to the ladder sections, with one set of strips dedicated to the rung alignment status indicator, and the other set of strips dedicated to the load status indicator.

As shown in FIGS. 7-8, the controller 45 can be in communication with the pressure sensors 46P associated with one or more of the hydraulic rams 46. The pressure sensors 46P can measure or detect the pressure of fluid within a ram. This data transfers to the controller 45. The controller takes this pressure data and translates it to the actual load exerted on the ladder. This load can be created by occupants on the ladder, equipment carried by the occupants, or an external force being placed on the ladder, for example near the tip by debris or other objects in contact with the ladder 50. Operation of the pressure sensor and calculation of the load is generally known and will not be repeated here.

Generally, the pressure sensors 46P can provide a continuous reading of the load on the aerial ladder. This load can be processed by the controller 45 to calculate load status of the ladder. Based on the results of the calculations, the controller can selectively illuminate the multiple lighting elements of the various lighting strips in the different sections, and/or the console load lights 44A, 44B and 44C on the console. Any one of the console load lights 44A, 44B and 44C can be selectively illuminated, depending on the particular load exerted on the aerial ladder.

In addition to the illumination of the console load lights, the load status indicator, and in particular the controller 45 can control the multiple lighting strips 81S, 82S and 83S to selectively illuminate the lighting elements thereon and provide visual output to a user on or about to enter the ladder regarding the status of the load on the ladder. The user can then take action to address the loading situation on the ladder, and potentially prevent overloading thereof. In some cases, certain ones of the console load lights, such as the cautionary load light 44B can flash, blink or illuminate selectively in the second warning mode to grab the attention of an operator standing at the console 44.

Figure 13:
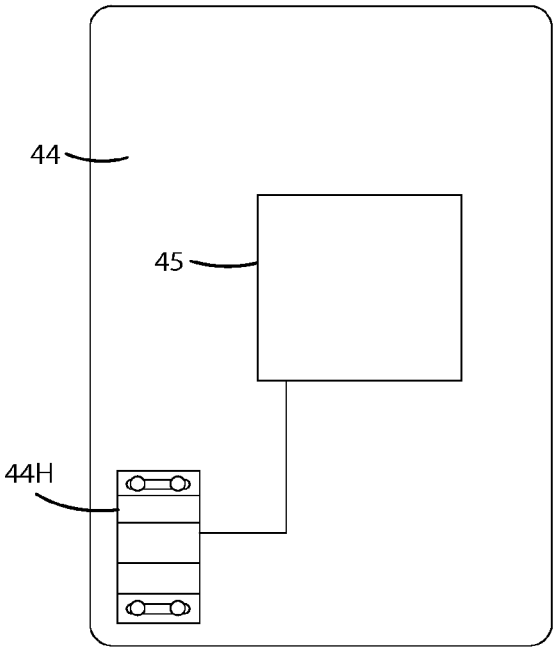
FIG. 13 is a perspective view of an audible alarm associated with the control console.

As shown in FIG. 13, the control console 44 optionally can be outfitted with an audible alarm 44H, which is illustrated in the form of a horn. Of course other audible alarms, such as bells, whistles, speakers and the like can be substituted for the horn as desired. The controller 45 controls the audible alarm 44H to emit particular sounds, depending on the load on the ladder and/or its relation to a preselected load rating capacity. As an example, the audible alarm 44H can sound when the ladder is overloaded optionally by about 0% to about 10% of its load rated capacity, further optionally by about 0% to about 10% of its load rated capacity. As another example, the audible alarm 44H can emit a constant sound when the load capacity is exceeded optionally by more than 10%, and further optionally by more than 20%. This can provide an audible warning to users on or about to enter the ladder regarding the status of the load on the ladder and the potential for an unsafe loading condition.

Figure 23:
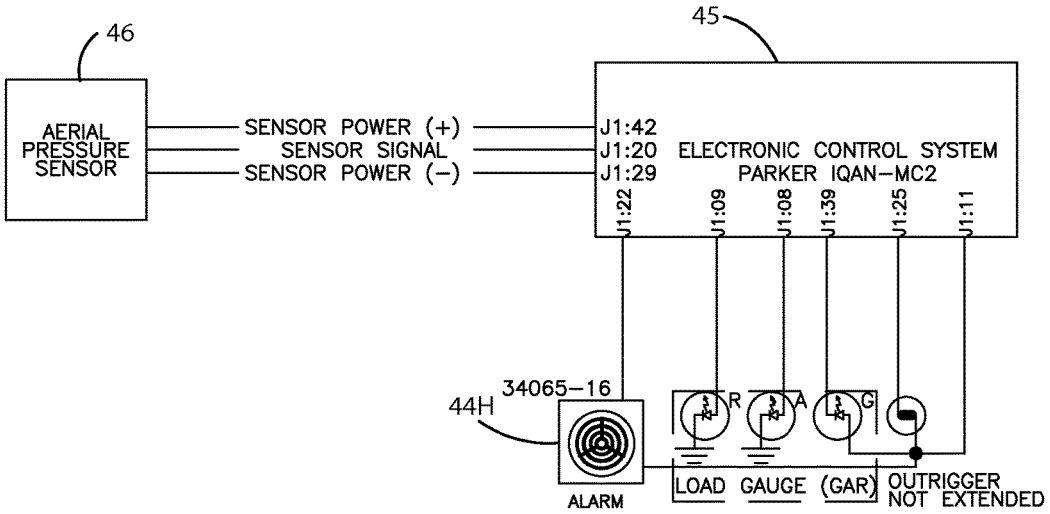
FIG. 23 is a schematic illustrating an aerial pressure sensor in communication with an electronic control system, which is in further communication with the load status indicator and an alarm.
Figure 24:
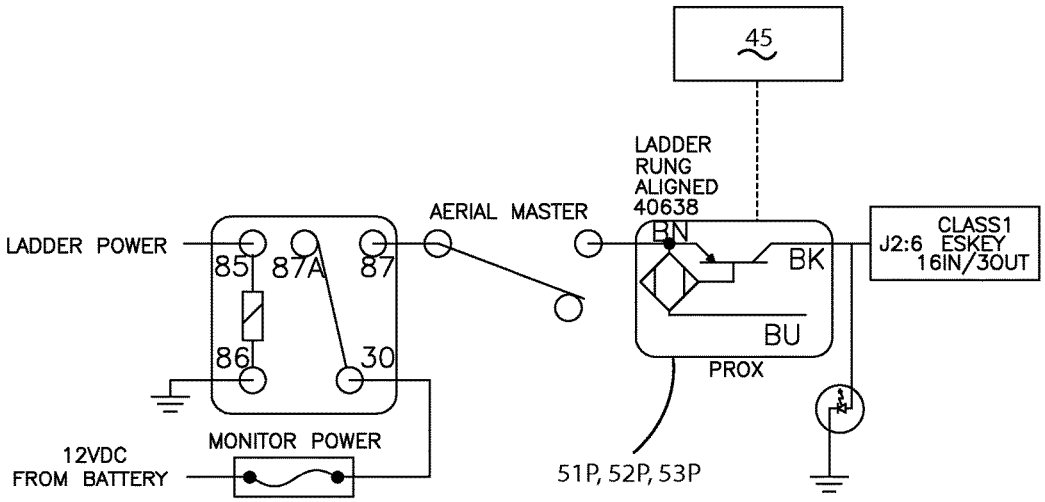
FIG. 24 is a schematic illustrating a proximity sensor in electrical communication with a control module that is in further communication with the rung alignment status indicator.

A schematic illustrating the aerial pressure sensor 46P in communication with the control 45 of the control console is illustrated in FIG. 23. As further illustrated there, the control is in communication with the alarm 44H. FIG. 24 is a schematic illustrating the electrical communication between proximity sensors 51P, 52P and 53P relative to power source. Of course, these proximity sensors can be in further communication with the controller 45 is explained above.

Figure 14:
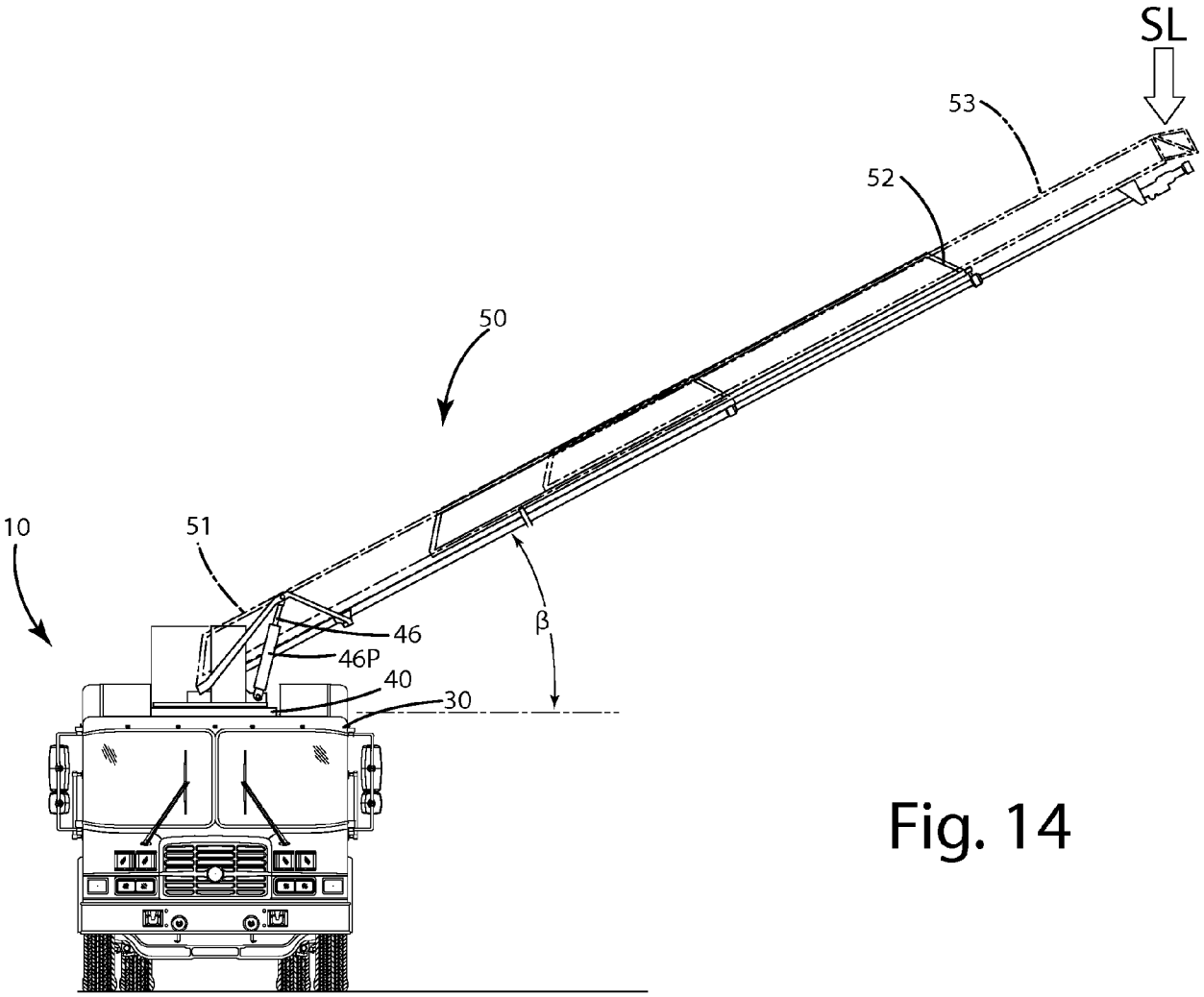
FIG. 14 is a front view of the apparatus with the aerial ladder sections extended and a safe load on the aerial ladder.
Figure 15:
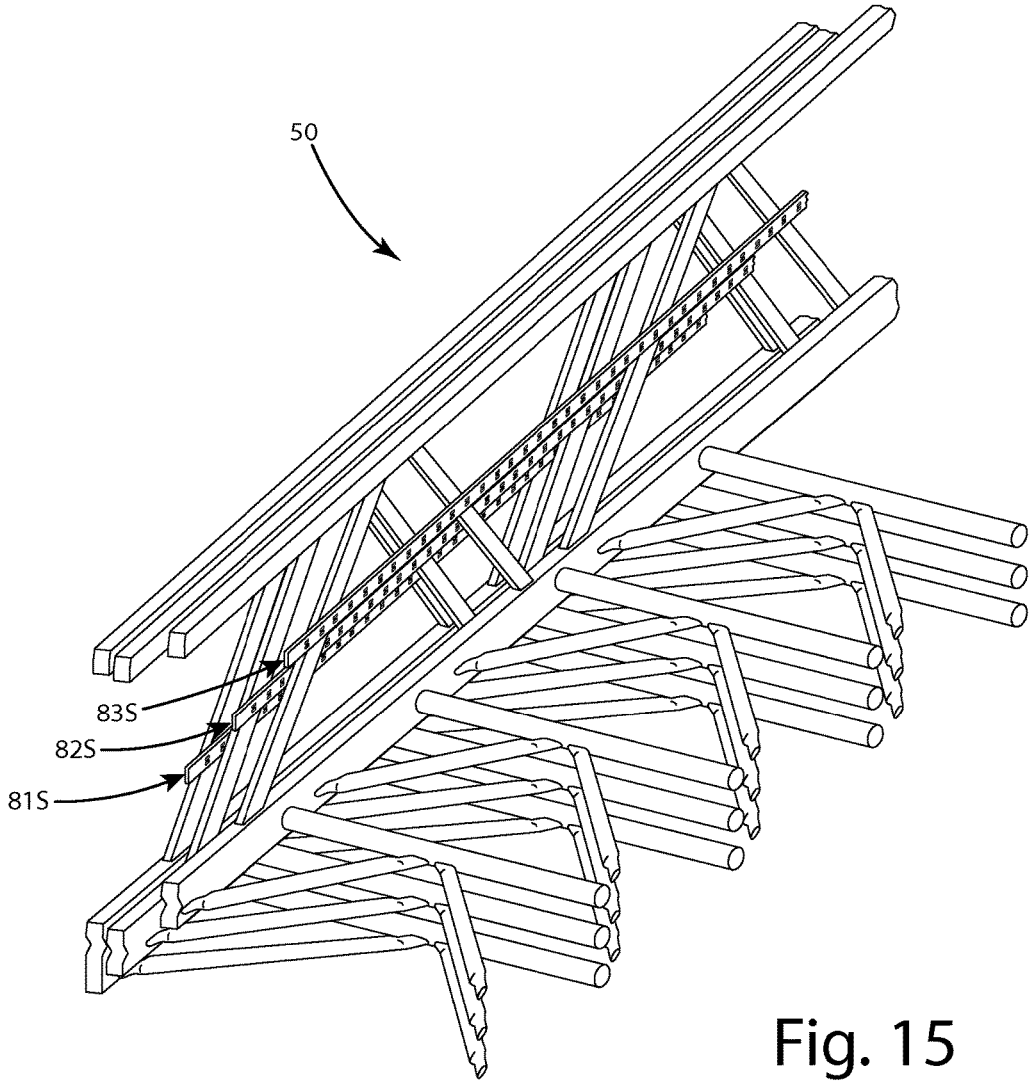
FIG. 15 is a perspective view of the apparatus with the aerial ladder sections extended and the load status indicator selectively illuminated to indicate a safe load on the aerial ladder.
Figure 16:
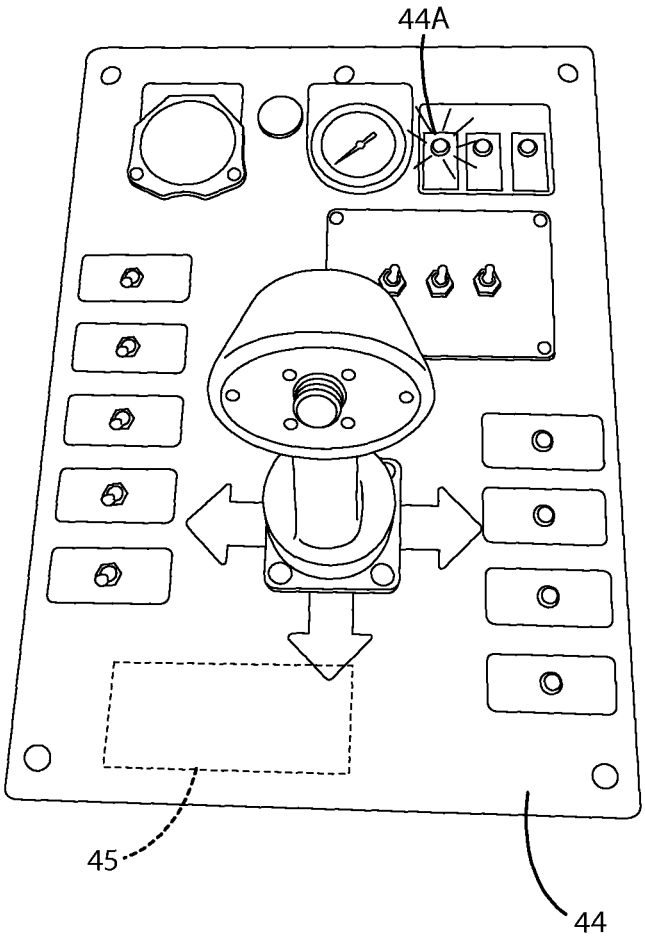
FIG. 16 is a perspective view of the control console with the safe console load light illuminated.

Operation of the aerial firefighting or rescue apparatus of the current embodiments will now be described in further detail. The firefighting apparatus 10, optionally in the form of an aerial fire truck, can be used to fight fires in a building or other structure and/or assist in rescue operations. In rescue operations, trapped victims can step onto the aerial ladder and traverse down the ladder to the turntable and off the truck 10 to safety. In some rescue and firefighting operations the aerial ladder can be disposed at an angle, for example angle β as shown in FIG. 14 relative to horizontal. In other situations the ladder 50 can be extended generally horizontally from the truck with the angle β close to zero to form a rescue bridge. The ladder can be used to provide access to a stranded motorist or boater, an individual trapped in a floodwater or building, or some other victim. In this manner, the ladder 50 can provide a bridge for individuals to traverse from one area onto the ladder 50 and truck 10.

During operation, the rung alignment status indicator can operate in at least one of a first warning mode and a first safe mode. For example, when the plurality of rungs 51R of one ladder section are aligned with the rungs 52R and or 53R of another ladder section in an alignment plane AP as shown in FIG. 10, the controller 45 senses this via input from one or more proximity sensors 51P, 52P and 53P. Based on the input from the proximity sensor, the controller 45 determines whether the rungs of one section are aligned or misaligned with the rungs of another section. If the rungs of one section are aligned with rungs of another section, the controller enters the first safe mode, controls the lighting strips 81S, 82S and 83S of the respective ladder sections and selectively illuminates the lighting elements thereof. The controller 45 also can selectively illuminate the rung alignment console light 49 as shown in FIG. 12 to indicate that the rungs are aligned to an operator at the control console 44.

During operation of the apparatus 10, the ladder sections inevitably are extended or retracted. Accordingly, the rungs change orientation and alignment relative to one another. When the rungs become misaligned, for example as shown in FIGS. 8A and 11, one or more of the proximity sensor detects this misalignment and provide input to the controller 45. The controller processes this input and enters the rung alignment status indicator into a first warning mode. In this warning mode, the controller can selectively illuminate the lighting strips 81S, 82S and 83S. For example, the lighting elements of the strips can be altered from a non-illuminated configuration as shown in FIG. 9 to an illuminated configuration as shown in FIG. 11. This can correspond to the rung aligned status indicator going from a first safe mode to a first warning mode.

Alternatively, where the lighting strips are illuminated in a first color as shown in FIG. 10 in a first safety mode, the controller can illuminate different lighting elements or generally change the color of the lighting strip to a different second color as shown in FIG. 11 in the first warning mode. The illumination or changing of color of the lighting elements on the strips can alert a user on or about to enter the ladder that the first warning mode is entered and that the rungs are potentially misaligned, which could present difficulty in establishing foothold on the respective rungs as the ladder is climbed.

In operation of the apparatus 10, the status indicator can further additionally or alternatively function as a load status indicator. Generally, the load status indicator operates in a second safe mode and one or more second warning modes. In these modes, the controller 45 determines the load on the ladder based on input from the pressure sensors 46P associated with the hydraulic rams 46 joined with the ladder 50. The pressure sensors 46P detect the fluid pressure within the ram. The controller 45 processes this pressure data to determine the actual load on the ladder. The controller compares the actual load to the load rated capacity and/or a preselected range of loads. Based on this, the controller 45 controls the lighting strips 81S, 82S and 83S to selectively illuminate the lighting elements on the strips. Optionally, the controller 45 can additionally or alternatively selectively illuminate the console load lights 44A, 44B, 44C.

As an example, when a safe load SL is applied to the ladder 50 in FIG. 14, the pressure sensors detect the pressure of fluid in the ram. This data is transferred to the controller. The controller can determine the actual load on the ladder and compare it to a load rating capacity. This load rating capacity can vary depending on the ladder and apparatus. Generally the load rating capacity can range from 500 pounds to 1500 pounds, or other forces as deemed appropriate in the application. With the safe load SL, the actual load is less than the capacity. Therefore, the controller establishes that the system is in the second safe mode, and selectively illuminates the lighting elements on the ladder. In one case, the safe mode can be indicated with the lighting elements simply not being illuminated to indicate the safe mode. In another case, the safe mode can be indicated with the lighting elements being illuminated in a first color that is associated with the loading being safe. Optionally, the controller 45 can additionally or alternatively selectively illuminate the "safe" console load light 44A on the console to indicate to the operator at the console that the load is acceptable.

Figure 17:
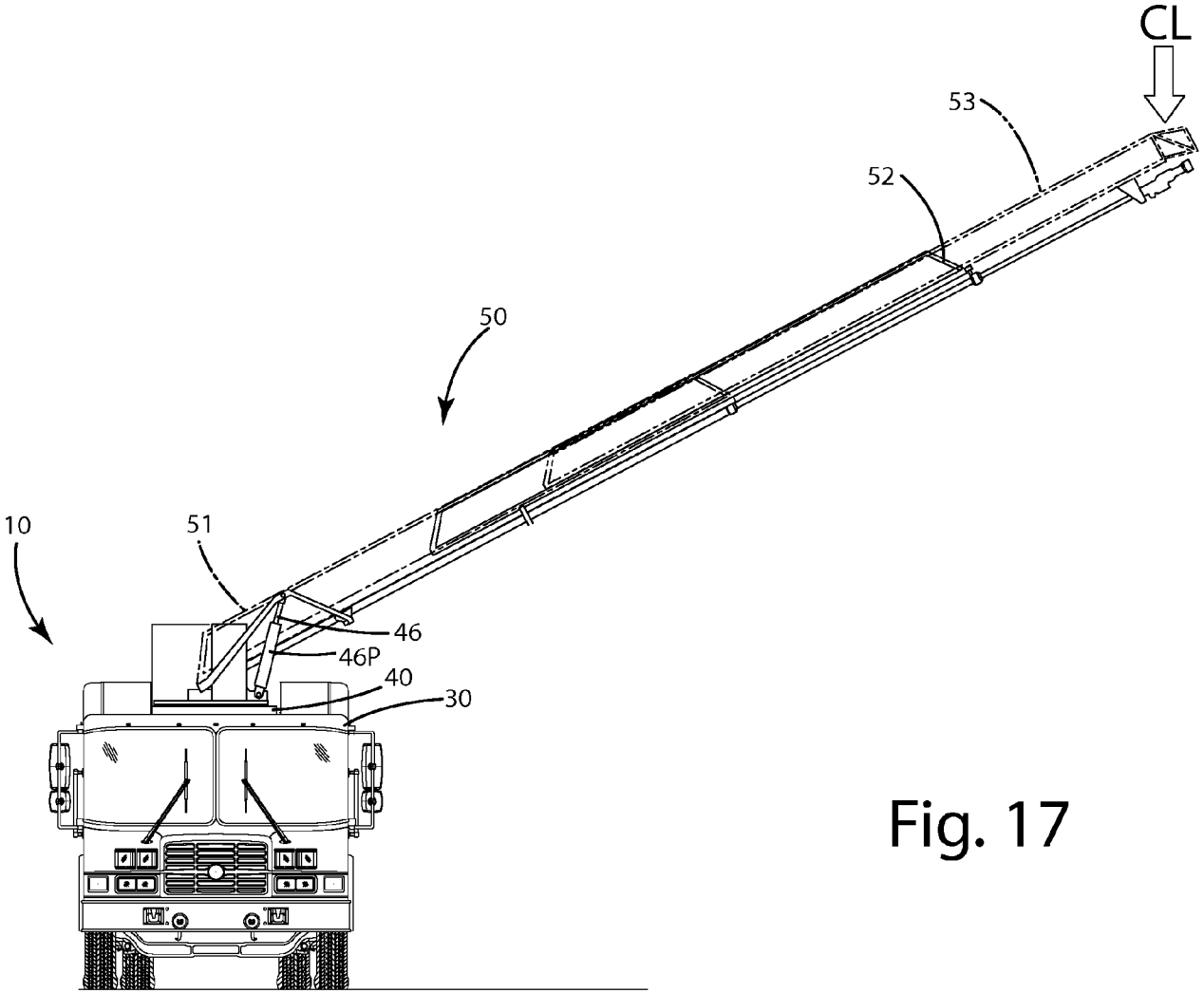
FIG. 17 is a front view of the apparatus with the aerial ladder sections extended and a cautionary load on the ladder.
Figure 18:
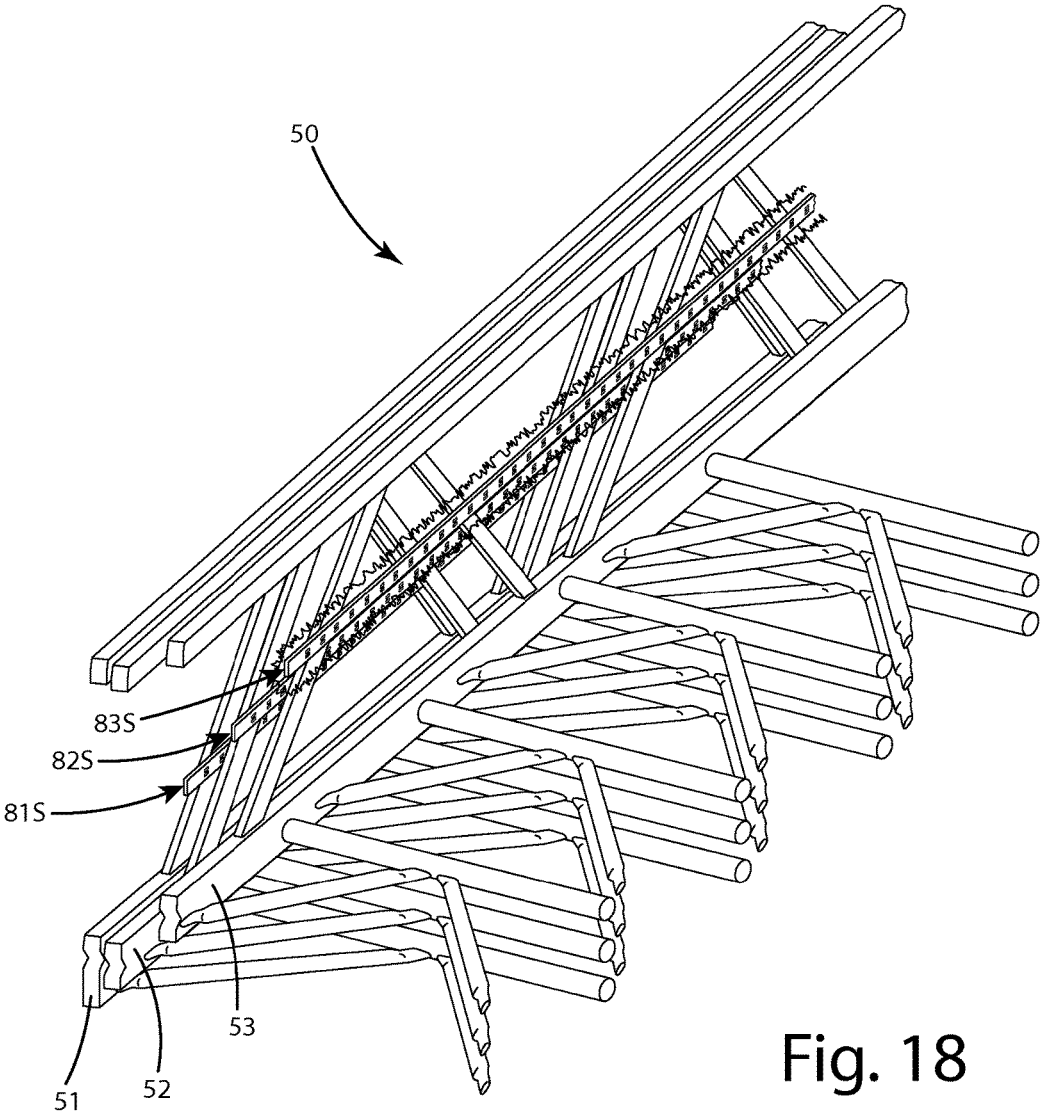
FIG. 18 is a perspective view of the apparatus with the aerial ladder sections extended and the load status indicator selectively illuminated to indicate that the load on the ladder is approaching or at a cautionary load.
Figure 19:
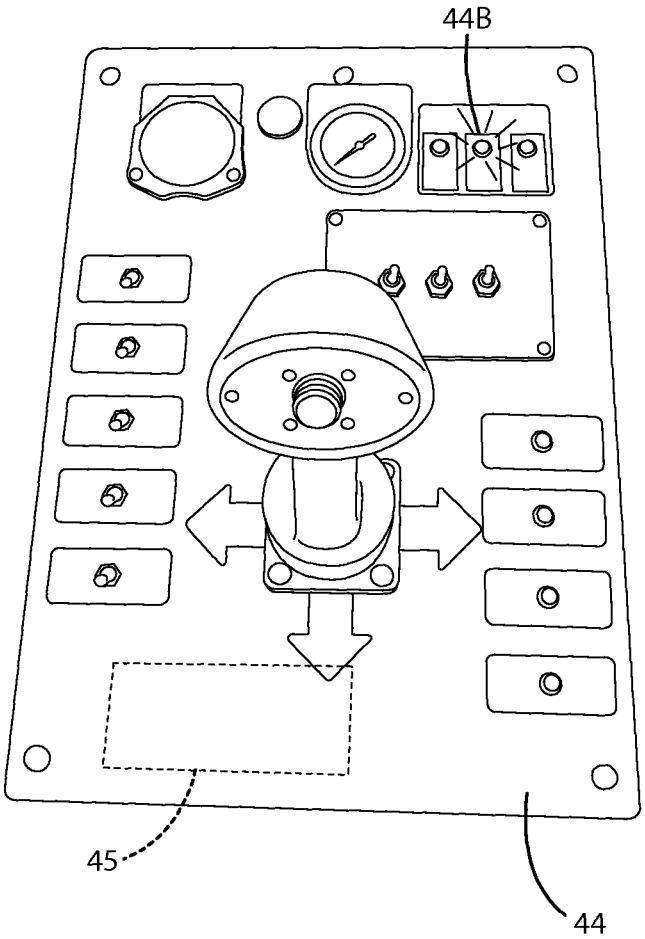
FIG. 19 is a perspective view of the control console with the console load light, in particular, the cautionary light, selectively illuminated when the aerial ladder is approaching overload.

As another example, when the load on the ladder is at or approaches a cautionary load CL as shown in FIG. 17 that load can be at or nearing a load rated capacity of the ladder. The pressure sensors sense the pressure, and like above, transfer the data to the controller to process as above. Based on the determination and identification of the cautionary load, the controller can selectively illuminate the lighting strips 81S, 82S and 83S as shown in FIG. 18 to alert a user on or adjacent the ladder that the load limit or load rated capacity is being approached and that additional care should be taken so that it is not exceeded. Optionally the controller 45 also illuminates the "cautionary" console load light 44B on the console 44. Further optionally the controller 45 can pulse the audible alarm 44H. This warning mode can generally be entered when the ladder is overloaded by about 0% to about 10% of its load rating capacity.

Figure 20:
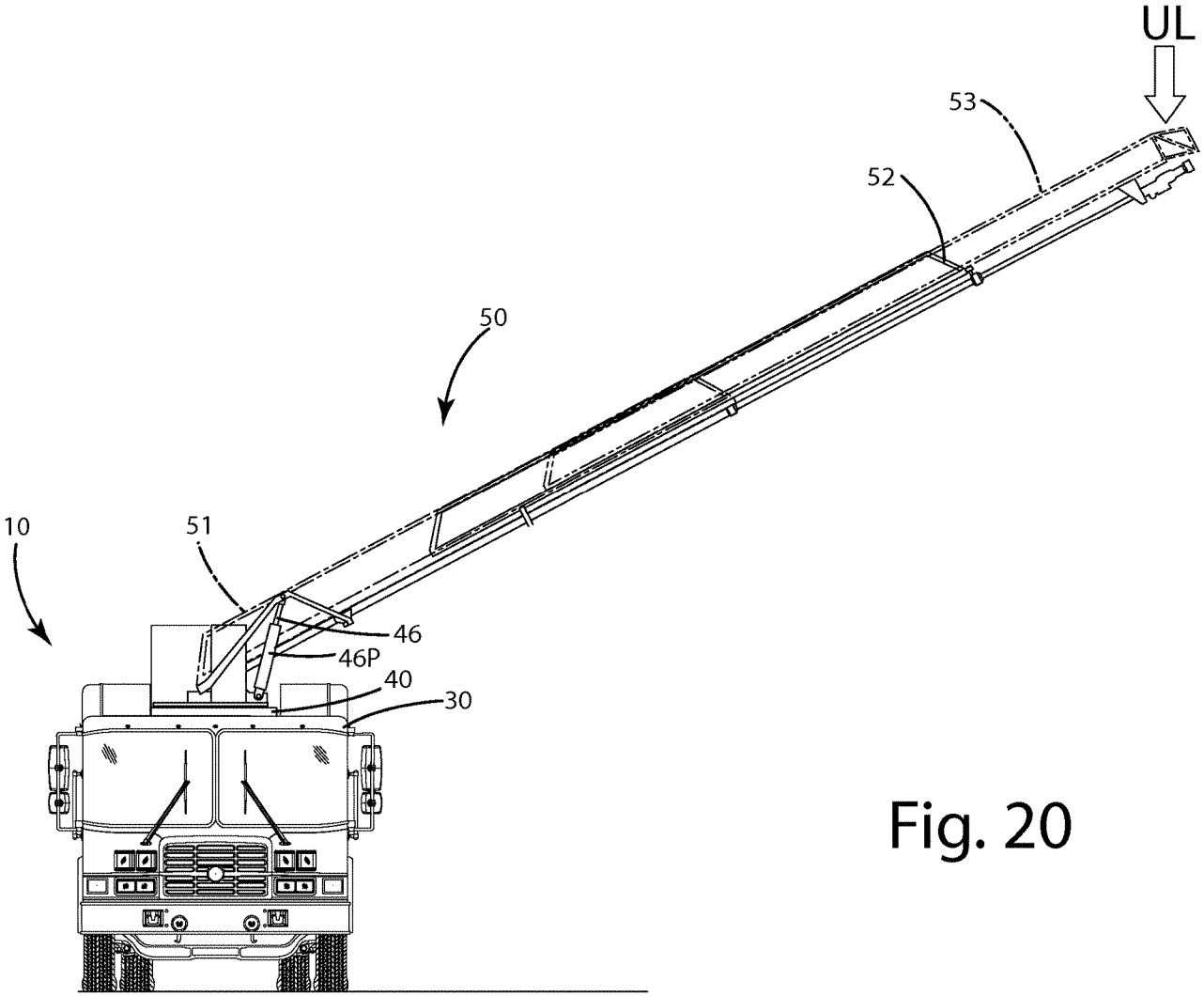
FIG. 20 is a front view of the apparatus with the aerial ladder sections extended and an unsafe load applied to the aerial ladder.
Figure 21:
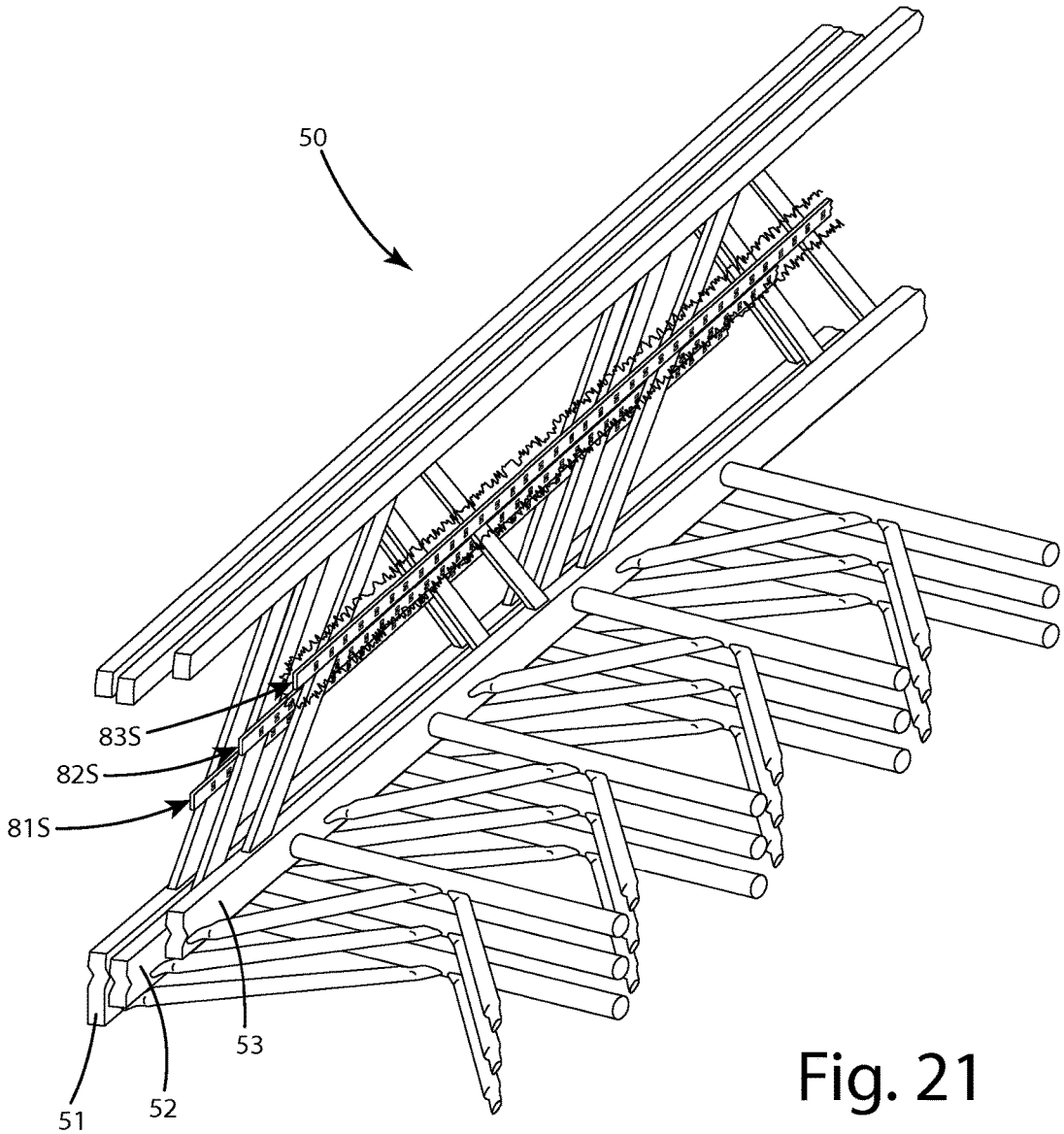
FIG. 21 is a perspective view of the aerial ladder with the load status indicator selectively illuminated to indicate that the aerial ladder is overloaded in a warning mode.
Figure 22:
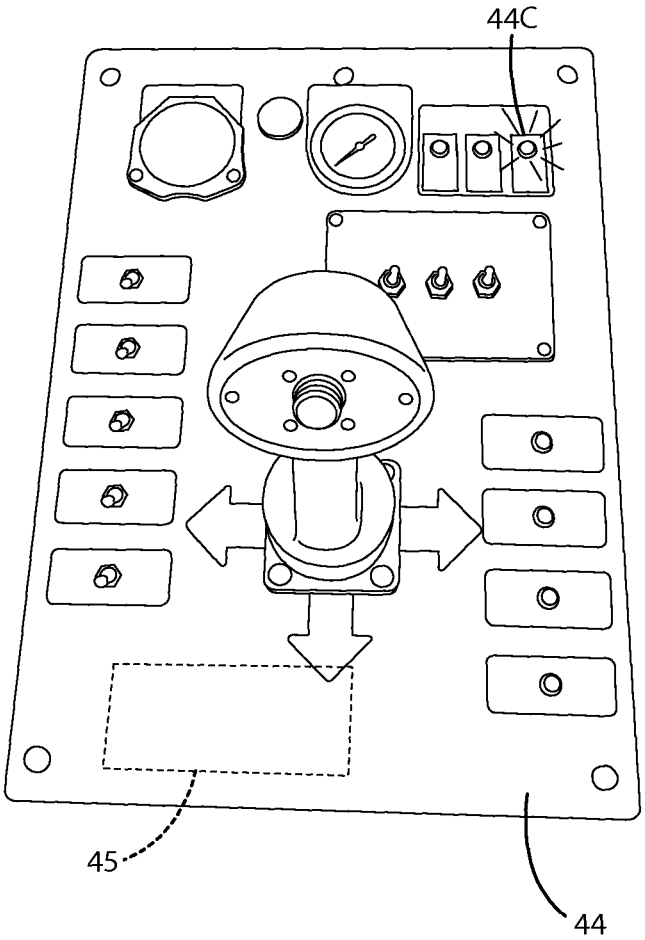
FIG. 22 is a perspective view of the control console with the console load light selectively illuminated to indicate an unsafe load on the aerial ladder.

As yet another example, when the actual load on the ladder 50 is or approaches an unsafe load UL as shown in FIG. 20, the load can generally exceed the load rating capacity by at least 10%, at least 20% or more. In this situation, the controller 45 selectively illuminates the "unsafe" console load light 44C to indicate to the operator standing at the console 44 that overload is eminent or reached, and that a potentially dangerous situation which could overturn or tip the truck, is approaching. The controller 45 also can selectively illuminate the lighting strips 81S, 82S and 83S to cause the multiple lighting elements to emit a different second or third color therefrom. This illumination and the particular color can be perceived and visualized by a user on or about to enter the ladder so that they can be directly aware of the unsafe load UL on the ladder. Accordingly the user can take action and avoid the potentially dangerous situation.

The rung alignment status indicator and the load status indicator can be utilized throughout the operation of the ladder at the emergency location. These indicators can provide output to operators near the ladder and/or users on or about to enter the ladder to update them as to the status of the ladder and its overall safety.

After the ladder 50 and truck 10 in general are no longer needed at the emergency location, the ladder can then be moved from its raised position to the generally horizontal stored position as shown in FIG. 1. The firefighting apparatus then can be transported to its garage or station.

After the ladder 50 is no longer needed at the emergency location, the ladder can then be moved from its raised position to the generally horizontal stored position as shown in FIGS. 1, 4 and 5. The firefighting apparatus then can be transported back to its garage or station.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An aerial firefighting apparatus comprising:

a frame including a plurality of wheels configured to enable transportation of the apparatus to an emergency location, the frame including a forward portion having a cab for housing at least one occupant of the apparatus, the frame including a rearward portion located rearward of the cab, the frame including a first side and a second side opposite the first side, the frame including at least one rear axle mounted to the frame in the rearward portion;

an aerial ladder that is both extendible and retractable, the aerial ladder comprising a base section and at least one upper ladder section movably joined with the base section so that the upper ladder section can be extended and retracted relative to the base section to provide extension and retraction of the aerial ladder, the aerial ladder being movably mounted relative to the frame so that the aerial ladder can be raised from a generally horizontal stored position to a raised position wherein the aerial ladder extends upwardly at an angle from the frame, the base section and the upper ladder section each including a plurality of rungs;

an aerial ladder raising and lowering mechanism, connected to the aerial ladder, being configured to move the aerial ladder between the generally horizontal stored position and the raised position;

a turntable to which the aerial ladder is mounted, the turntable being selectively rotatable so that the base section can be swung to a plurality of positions;

a waterway comprising a water outlet, the waterway joined with the aerial ladder, the water outlet adapted to shoot pressurized firefighting fluid provided from a fire fighting fluid source; and a status indicator being a rung alignment status indicator, the status indicator including an elongated strip extending along at least one of the upper ladder section and the base section, the elongated strip having a plurality of lighting elements joined therewith, configured to be visible when illuminated to a user located on the ladder, and configured to be visible when illuminated to a user about to enter the ladder, wherein the rung alignment status indicator is operable in a first warning mode when the plurality of rungs of the base section and the upper ladder section are misaligned with respect to each other such that the respective rungs fail to present a safe foothold for a user, and a first safe mode when the plurality of rungs of the base section and the upper ladder section are aligned with respect to each other in order to present a safe foothold for a user climbing the ladder, whereby the status indicator is configured so that the user on the aerial ladder or about to enter the aerial ladder can visually perceive the status indicator while on the aerial ladder or about to enter the aerial ladder to discern, as a direct result of the modes of the rung alignment status indicator, whether the aerial ladder is in a configuration having said aligned rungs, and to discern, as a direct result of the modes of the rung alignment status indicator, whether the aerial ladder is in a configuration having said misaligned rungs.

2. The aerial firefighting apparatus of claim 1, wherein the plurality of lighting elements joined with the elongated strip are LEDs, wherein the LEDs are configured to emit illumination of a first color in the first warning mode and emit illumination of a second color in the first safe mode.

3. The aerial firefighting apparatus of claim 1, wherein the plurality of lighting elements joined with the elongated strip are LEDs, wherein the LEDs are configured to emit illumination in the first warning mode and emit no illumination in the first safe mode.

4. The aerial firefighting apparatus of claim 1, wherein the status indicator includes both the rung alignment status indicator and a load status indicator, wherein the rung alignment status indicator is configured to emit illumination from the plurality of lighting elements when the rung alignment status indicator is in the first safe mode to alert the user to that the rungs are properly aligned, whereby the user can perceive that the user can obtain a safe foothold on the respective rungs to climb the ladder, wherein the load status indicator is configured to emit illumination from the plurality of lighting elements when the load status indicator is in a second warning mode to alert the user to loading status on the ladder.

5. The aerial firefighting apparatus of claim 1 comprising a control console located adjacent the turntable, distal from the aerial ladder, the control console including at least one console lighting element that is physically separate from the elongated strip having the plurality of lighting elements, the at least one console lighting element configured to be visible to an operator of the control console, but not to a user located on the aerial ladder, the at least one console lighting element being illuminated or not illuminated depending on whether the rung alignment status indicator is in a second warning mode or a second safe mode.

6. An aerial firefighting apparatus comprising:

a frame configured to enable transportation of the apparatus to an emergency location, the frame including a forward portion, a rearward portion, a rear, a first side and a second side opposite the first side;

an aerial ladder that is both extendible and retractable, the aerial ladder comprising a lower ladder section and an upper ladder section movably joined with the lower ladder section so that the upper ladder section can be extended and retracted relative to the lower ladder section to provide extension and retraction of the aerial ladder, the aerial ladder being movably mounted relative to the frame so that the aerial ladder can be raised from a generally horizontal stored position to a raised position wherein the aerial ladder extends upwardly at an angle from the frame, the lower ladder section including a plurality of first rungs, the upper ladder section including a plurality of second rungs;

a turntable to which the aerial ladder is mounted, the turntable being selectively rotatable so that the lower ladder section can be swung to a plurality of positions;

a sensor disposed on the aerial ladder, the sensor configured to sense a first condition where the plurality of first rungs and the plurality of second rungs are aligned with respect to each other, and configured to sense a second condition where the plurality of first rungs and the plurality of second rungs are misaligned with respect to each other; and a rung alignment status indicator in communication with the sensor, the rung alignment status indicator including a lighting strip including a plurality of lighting elements, the plurality of lighting elements configured to be illuminated as a direct result of whether the plurality of first rungs and the plurality of second rungs are in the first aligned condition, and as a direct result of being in the second misaligned condition, the lighting strip extending from a first end toward a distal, second end of at least one of the first upper ladder section and the lower ladder section, whereby the rung alignment status indicator is configured so that a user on the aerial ladder or about to enter the aerial ladder can visually perceive the rung alignment status indicator while on the aerial ladder or about to enter the aerial ladder to discern whether the aerial ladder is in a configuration having appropriate rung alignment so that the user can attain a foothold when climbing at least one of the plurality of first rungs and the plurality of second rungs.

7. The aerial firefighting apparatus of claim 6 comprising a control console mounted adjacent the aerial ladder, the control console including a console alignment light in communication with the sensor, the console alignment light configured to illuminate depending on whether the plurality of first rungs and the plurality of second rungs are aligned or misaligned, the console alignment light being separate and distal from the lighting strip.

8. The aerial firefighting apparatus of claim 6, wherein the elongated strip includes a plurality of LEDs, wherein the plurality of LEDs are disposed along at least one of the upper ladder section and the lower ladder section, wherein the plurality of LEDs extend from a lower end to an upper end of at least one of the upper ladder section and the lower ladder section, whereby the LEDs are configured so that a user situated on at least one of the plurality of first and second rungs can visually perceive selective illumination of the plurality of LEDs, whereby the plurality of LEDs are configured so that an operator at the control console can visually perceive selective illumination of the plurality of LEDs while located at the control console.

9. The aerial firefighting apparatus of claim 6, wherein the plurality of lighting elements include first lighting elements that are illuminated a first color to illuminate at least one of the plurality of first rungs and plurality of second rungs when the plurality of first rungs and the plurality of second rungs are aligned, and configured to assist the user in visually perceiving the plurality of first and second rungs while the user traverses the plurality of first and second rungs, wherein the plurality of lighting elements include second lighting elements that are illuminated a second color, different from the first color, when the plurality of first rungs and the plurality of second rungs are misaligned to warn the user that the rungs are misaligned.

10. The aerial firefighting apparatus of claim 6 comprising a load status indicator and a pressure sensor joined with the aerial ladder, wherein the load status indicator is configured to emit illumination from the plurality of lighting elements when the load status indicator is in a first warning mode to alert the user to an overloading of the ladder.

11. The aerial firefighting apparatus of claim 6, comprising a load status indicator and a pressure sensor joined with the aerial ladder, wherein the load status indicator is configured to emit illumination of a first color from the plurality of lighting elements when the load status indicator is in a warning mode to alert the user to an overloading of the ladder, wherein the load status indicator is configured to emit illumination of a second, different color from the plurality of lighting elements when the load status indicator is in a safe mode in which the ladder is not overloaded.

* * * * *